US008646769B2

(12) United States Patent
Unno

(10) Patent No.: US 8,646,769 B2
(45) Date of Patent: Feb. 11, 2014

(54) PRINTING APPARATUS, METHOD FOR CONTROLLING PRINTING APPARATUS, PROGRAM, AND STORAGE MEDIUM

(71) Applicant: Canon Kabushiki Kaisha, Tokyo (JP)

(72) Inventor: Koichi Unno, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/902,604

(22) Filed: May 24, 2013

(65) Prior Publication Data

US 2013/0256974 A1 Oct. 3, 2013

Related U.S. Application Data

(63) Continuation of application No. 12/339,798, filed on Dec. 19, 2008, now Pat. No. 8,469,353.

(30) Foreign Application Priority Data

Dec. 27, 2007 (JP) ..... 2007-336842

(51) Int. Cl.
*B65H 3/44* (2006.01)
*B65H 5/26* (2006.01)

(52) U.S. Cl.
USPC ..... 271/9.02; 271/9.03

(58) Field of Classification Search
USPC ..... 271/9.02, 9.03
See application file for complete search history.

(56) References Cited

U.S. PATENT DOCUMENTS

| | | | | | |
|---|---|---|---|---|---|
| 3,951,264 | A * | 4/1976 | Heidecker et al. | 206/308.3 |
| 4,484,734 | A * | 11/1984 | Tsudaka et al. | 271/9.03 |
| 4,763,889 | A * | 8/1988 | Dei et al. | 271/9.03 |
| 4,885,613 | A * | 12/1989 | Kudoh | 399/23 |
| 5,028,041 | A * | 7/1991 | Kobayashi | 271/9.03 |
| 5,168,316 | A * | 12/1992 | Hino et al. | 399/23 |
| 5,347,350 | A * | 9/1994 | Nakahata et al. | 399/23 |
| 5,991,556 | A * | 11/1999 | Yamashita | 399/23 |
| 7,377,506 | B2 * | 5/2008 | Miyajima | 271/9.03 |
| 7,480,467 | B2 * | 1/2009 | Ueki et al. | 399/23 |
| 7,547,010 | B2 * | 6/2009 | Yokobori et al. | 271/9.01 |
| 8,002,259 | B2 * | 8/2011 | Kishimoto et al. | 271/9.01 |
| 2005/0104272 | A1 * | 5/2005 | Watanabe et al. | 271/9.05 |
| 2007/0047979 | A1 * | 3/2007 | Ai | 399/23 |
| 2008/0019713 | A1 * | 1/2008 | Shinchi et al. | 399/38 |

* cited by examiner

*Primary Examiner* — Prasad Gokhale
(74) *Attorney, Agent, or Firm* — Canon USA Inc. IP Division

(57) ABSTRACT

A printing apparatus performs printing with the use of sheets of paper set in any of a plurality of paper-feeding units. The print apparatus is controlled by a method including: determining whether the amount of sheets of paper remaining in a first paper-feeding unit has reached a predetermined amount; and if so switching from the first paper-feeding unit to a second paper-feeding unit. If it is determined that the amount of sheets of paper that remain in the first paper-feeding unit has reached the predetermined amount, control is performed so that the paper-feeding unit that is used for printing should be changed after the ejection of the last one of a plurality of sheets of paper that are included in one set thereof set in the first paper-feeding unit.

14 Claims, 17 Drawing Sheets

FIG. 9

1301

PAPER-FEEDING UNIT INFORMATION TABLE

| PAPER-FEEDING UNIT | PAPER SIZE | NAME | BASIS WEIGHT | FEATURE | SURFACE NATURE | NUMBER OF TABS |
|---|---|---|---|---|---|---|
| PAPER-FEEDING CASSETTE 1 | A4 | INDEX PAPER (151−180 g/m$^2$) | 93 | INDEX PAPER | PREMIUM PAPER | 5 |
| PAPER-FEEDING CASSETTE 2 | A4 | INDEX PAPER (151−180 g/m$^2$) | 93 | INDEX PAPER | PREMIUM PAPER | 5 |
| PAPER-FEEDING DECK | A4 | PLAIN PAPER (80−105 g/m$^2$) | 117 | N/A | PREMIUM PAPER | 0 |
| MANUAL PAPER-FEEDING TRAY | A4 | PLAIN PAPER (80−105 g/m$^2$) | 117 | N/A | PREMIUM PAPER | 0 |

1302

1303 1304 1305 1306 1307 1308 1309

FIG. 17

| DIRECTORY INFORMATION |
| --- |
| A GROUP OF PROGRAM CODES CORRESPONDING TO STEPS OF FLOWCHART SHOWN IN FIG. 10 |
| A GROUP OF PROGRAM CODES CORRESPONDING TO STEPS OF FLOWCHART SHOWN IN FIG. 11 |
| A GROUP OF PROGRAM CODES CORRESPONDING TO STEPS OF FLOWCHART SHOWN IN FIG. 13 |
| |

PRINTING APPARATUS, METHOD FOR CONTROLLING PRINTING APPARATUS, PROGRAM, AND STORAGE MEDIUM

CROSS REFERENCE TO RELATED APPLICATIONS

This application is a Continuation of U.S. patent application Ser. No. 12/339,798 filed Dec. 19, 2008, which claims priority from Japanese Application No. 2007-336842 filed Dec. 27, 2007, both of which are hereby incorporated by reference in their entirety.

BACKGROUND OF THE INVENTION

1. Field of the Invention

The present invention relates to a printing apparatus that can accept a plurality of jobs. In addition, the invention further relates to a method for controlling such a printing apparatus, a program, and a storage medium.

2. Description of the Related Art

Some printing apparatuses have an auto cassette change (ACC) function. After a paper-feeding unit that is being used for printing has run out of sheets of paper having a size required for printing, a known printing apparatus having the ACC function automatically searches for a substitute paper-feeding unit with sheets of paper having the same size as that of the sheets of paper set in the paper-feeding unit that has run out. The ACC function enables such a printing apparatus to continue printing by feeding the sheets of paper set in the substituted paper-feeding unit. Therefore, it is possible to continue printing when the paper-feeding unit that is currently being used for printing has run out of sheets without any need for a user to give manual instructions for performing a paper-feeding unit switchover.

When such an ACC function is used, however, it is only after the paper-feeding unit that is currently being used for printing has run out of sheets that the printing apparatus starts an automatic search for a substitute paper-feeding unit that can take over the job. Upon finding the substitute paper-feeding unit, the paper-feeding source is switched over from the paper-feeding unit that has run out of the sheets to the substitute paper-feeding unit. Then, print operations are resumed by feeding sheets from the substitute paper-feeding unit. When such cassette change processing is performed, it is impossible to feed any sheet of paper from a point in time at which it was detected that the paper-feeding unit had run out of sheets to a point in time at which the feeding of sheets is resumed. Therefore, print operations have to be paused during such a time period, which results in downtime.

As a technique for improving the ACC function, a method for continuing printing with the use of sheets set in a substitute paper-feeding unit without waiting for the running out of sheets of paper having a size required for printing at the paper-feeding unit that is currently being used for printing has been proposed in the technical field to which the present invention pertains (Japanese Patent Laid-Open No. 2008-030451). In such an improved ACC method, when it is detected that the amount of sheets remaining in a paper-feeding unit that is currently being used for print processing has reached a predetermined amount, a substitute paper-feeding unit in which sheets having the same size as that of the sheets set in the currently-used paper-feeding unit are set is searched for while continuing the print processing with the use of sheets remaining in the currently-used paper-feeding unit. Then, upon the finding of the substitute paper-feeding unit, the printing apparatus performs control so that paper should be fed from the found substitute paper-feeding unit. Therefore, it is possible to decrease the possibility that paper-feeding operation is paused, which results in reduction in downtime.

Another known printing apparatus can output printed sheets with sheets of index paper being inserted at arbitrary page positions in a stack of outputted sheets. Prior to such index insertion, sets of sheets of index paper each made up of more than one sheet have been provided in a paper-feeding unit of the printing apparatus. Such a printing apparatus makes it possible for a user to easily identify each section in the text of the printed sheets while using each index sheet inserted as a mark.

However, when sheets of print-processing target medium each set of which is made up of more than one sheet are set in a paper-feeding unit, in some cases, it is not possible to obtain a correct output if the paper-feeding units are switched from the current one to another upon detecting that the remaining amount of sheets set therein has reached a predetermined amount.

For example, it is assumed herein that printing is performed under a job instruction that five index sheets should be inserted in each print copy, that is, in each one set of sheets that are to be outputted for the job. If a paper-feeding source is switched from the paper-feeding unit that is currently being used for feeding index paper to a substitute paper-feeding unit at a point in time at which only three of five index sheets have been inserted, which means that two index sheets have not been inserted yet, upon detecting that the remaining amount of sheets set in the currently-used paper-feeding unit has reached the predetermined amount, index sheets will not be inserted correctly in the print output.

However, if it is controlled so that a paper-feeding unit switchover should be performed only after the index paper-feeding unit that is currently being used for the feeding of index paper has run out of index sheets, print operations have to be paused due to a failure in the feeding of index paper that occurs as a result of the running-out of index sheets set in the currently-used paper-feeding unit, which results in downtime.

SUMMARY OF THE INVENTION

The present invention provides a printing apparatus and a print control method that addresses the above-described problem, without any limitation thereto.

In order to address the above-identified problem without any limitation thereto, the invention provides, as an aspect thereof, a printing apparatus for executing a job with the use of sheets of a processing target medium provided in any of a plurality of sheet-feeding units, including: a determining unit configured to determine whether the amount of sheets of the processing target medium that remain in a first sheet-feeding unit that is used for the execution of the job has reached a predetermined amount; and a control unit configured to change the sheet-feeding unit that is used for the execution of the job from the first sheet-feeding unit to a second sheet-feeding unit in response to the determination made by the determining unit that the amount of sheets of the processing target medium that remain in the first sheet-feeding unit has reached the predetermined amount, wherein, if it is determined by the determining unit that the amount of sheets of the processing target medium that remain in the first sheet-feeding unit has reached the predetermined amount, the control unit performs control so that the sheet-feeding unit that is used for the execution of the job is changed at a point in time after the ejection of the last one of a plurality of sheets of the processing target medium that are included in one set thereof set in the first sheet-feeding unit.

Further features of the present invention will become apparent from the following description of exemplary embodiments with reference to the attached drawings.

BRIEF DESCRIPTION OF THE DRAWINGS

The accompanying drawings, which are incorporated herein so as to constitute a part of disclosure, illustrate embodiments of the invention, and, together with the description of the specification, serve to explain the principle of the invention.

FIG. 9 is a diagram that schematically illustrates an example of a paper-feeding unit information table that is looked up by a controller unit 205 according to an embodiment of the invention.

FIG. 17 is a diagram that schematically illustrates a group of program codes according to an exemplary embodiment of the invention.

DESCRIPTION OF THE EMBODIMENTS

With reference to the accompanying drawings, exemplary embodiments of the present invention will now be explained in detail.

Figure 1:
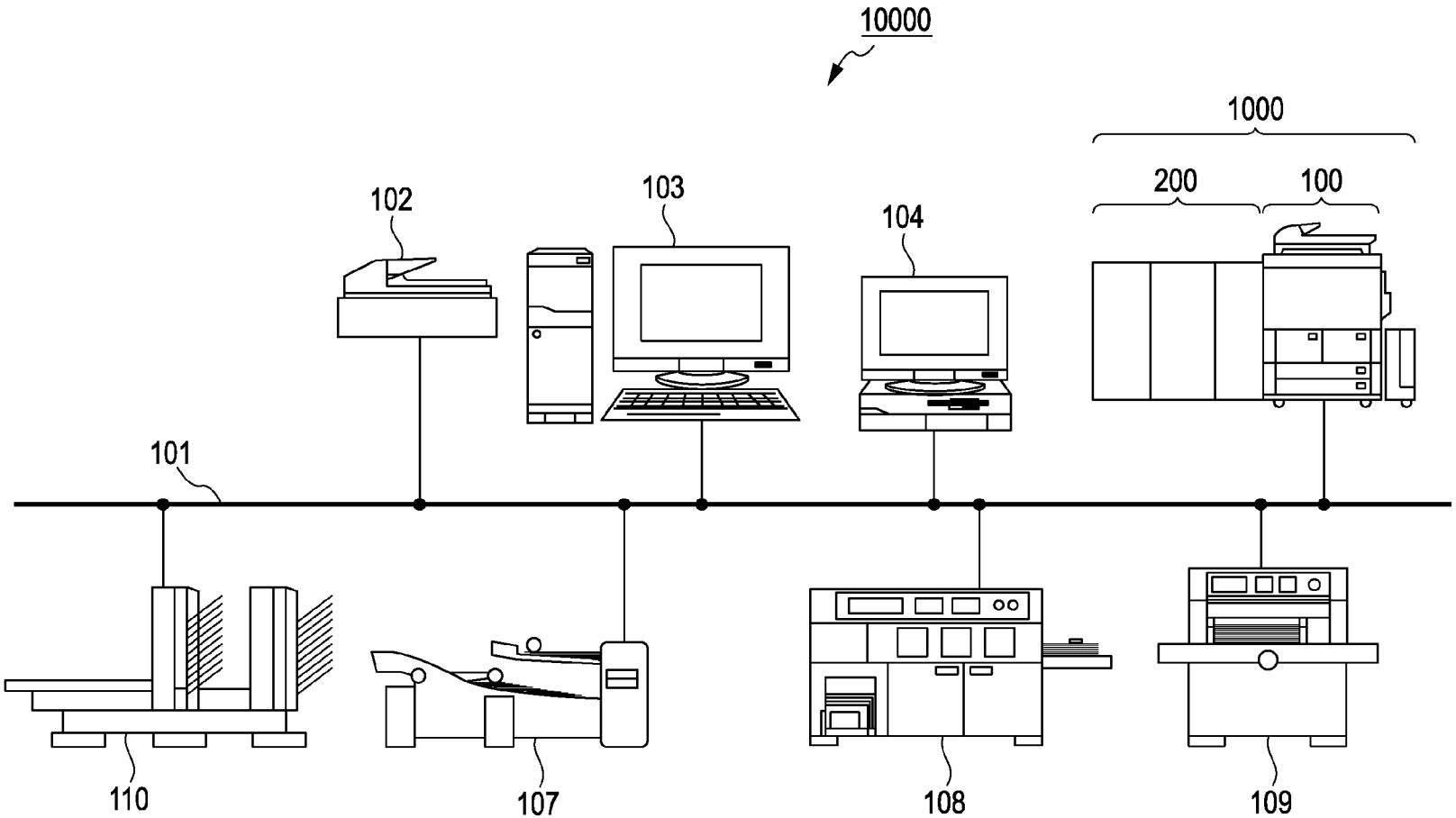
FIG. 1 is a diagram that schematically illustrates an example of the configuration of a POD system 10000 according to an embodiment of the invention.

A print-on-demand (POD) system 10000 that is illustrated in FIG. 1 includes a printing system 1000, a scanner 102, a server computer 103 (hereafter referred to as PC 103), and a client computer 104 (hereafter referred to as PC 104). The printing system 1000, the scanner 102, the PC 103, and the PC 104 are interconnected via a network 101. The POD system 10000 further includes a folding machine 107, a trimmer 109, a saddle stitching machine 110, a case binding machine 108, and the like.

The printing system 1000 includes a printing apparatus 100 and a sheet processing apparatus 200. The configuration of the printing system 1000 will be described later while referring to FIG. 2. A multi-function peripheral (MFP) that has a plurality of functions such as a copying function, a printing function, and the like is taken as an example of the printing apparatus 100 according to the present embodiment of the invention. Notwithstanding the above, however, the printing apparatus 100 may be configured as a single-function peripheral that has, for example, a copying function only or a printing function only.

The PC 103 manages the transmission/reception of data between the network-component apparatuses connected to the network 101. The PC 104 transmits image data to the printing apparatus 100 or the PC 103 via the network 101.

The folding machine 107 folds a sheet of print target medium such as paper on which printing has been performed at the printing apparatus 100. Hereafter, a sheet on which printing has been performed at the printing apparatus 100 may be referred to as a sheet printed at the printing apparatus 100 or simply as a printed sheet. The case-binding machine 108 performs case-binding processing on sheets of paper printed at the printing apparatus 100. The trimmer 109 performs trimming on a stack of sheets printed at the printing apparatus 100. The saddle-stitching machine 110 performs saddle-stitching processing on sheets of paper printed at the printing apparatus 100.

When any of the folding machine 107, the case binding machine 108, the trimmer 109, and the saddle stitching machine 110 is used, a user takes sheets on which printing has been performed at the printing apparatus 100 out of the printing system 1000 and then sets the taken-out sheets on the machine that is to be used for demanded processing. All machines and apparatuses of the POD system 10000 shown in FIG. 1 except for the saddle-stitching machine 110 are connected to the network 101. Therefore, these machines and apparatuses excluding the saddle-stitching machine 110 can perform data communication via the network 101 with one another.

Next, the configuration of the printing system 1000 is explained below while referring to the system block diagram of FIG. 2.

Figure 2:
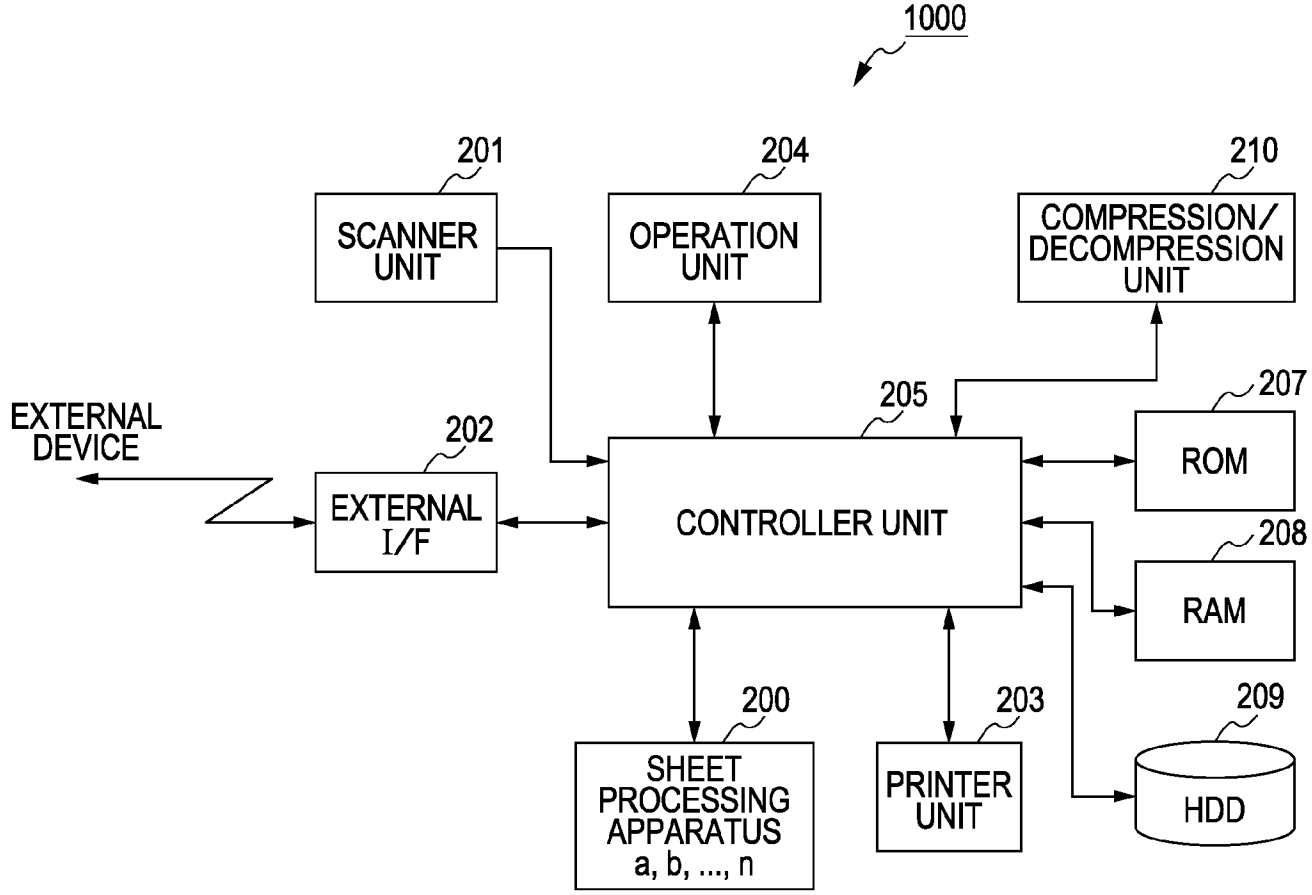
FIG. 2 is a block diagram that schematically illustrates an example of the configuration of a printing system 1000 according to an embodiment of the invention.

As illustrated in FIG. 2, the printing system 1000 includes the printing apparatus 100 and the sheet processing apparatus 200. All units of the printing system 1000 that are shown in FIG. 2, except for the sheet processing apparatus 200, are the components of the printing apparatus 100. Arbitrary number of sheet processing apparatuses 200*a*, 200*b*, . . . , 200*n* can be connected to the printing apparatus 100.

In the configuration of the printing system 1000, the sheet processing apparatus 200 that is connected to the printing apparatus 100 can perform sheet processing on sheets of paper printed at the printing apparatus 100. Notwithstanding the above, however, the printing system 1000 may be made up of the printing apparatus 100 only. That is, the sheet processing apparatus 200 connected to the printing apparatus 100 may not be provided.

The sheet processing apparatus 200, which is capable of performing communication with the printing apparatus 100, performs sheet processing upon the reception of instructions from the printing apparatus 100. A more detailed explanation of the sheet processing will be given later.

A scanner unit 201 reads, for example, an image drawn on a sheet of an original document. The scanner unit 201 converts the scanned image into image data and then sends the image data to another processing unit. An external I/F unit 202 transmits data to, and receives data from, another machine that is connected to the network 101. A printer unit 203 prints an image on a sheet of paper on the basis of inputted image data. An operation unit 204 has a hard key input unit 402 (refer to FIG. 4) and a touch panel 401 (refer to FIG. 4). The operation unit 204 accepts instructions from a user through the manipulation of the hard key input unit 402 and the touch panel 401. The operation unit 204 displays various kinds of information and the like on the touch panel that is built therein.

As a central controller, a controller unit 205 controls the processing and operation of all other units of the printing system 1000. Note that the controller unit 205 controls not only the operation of the components of the printing apparatus 100 but also the operation of the sheet processing apparatus 200, which is connected to the printing apparatus 100.

A ROM 207 stores various kinds of programs that are executed by the controller unit 205. For example, the ROM 207 stores a program that is used for the execution of various kinds of flowchart operations, which will be explained later. In addition, the ROM 207 stores a display control program that is used for displaying various setting screens, which will be also explained later. Moreover, the ROM 207 stores paper information, which contains name, basis weight (i.e., paper weight), surface nature, and the like in association with paper type. Such associated information is stored in the ROM 207 for each type of paper (which may be referred to as "print target medium" or "sheet" herein) that can be set on a paper-feeding unit.

Furthermore, the ROM 207 stores other various programs such as a program for expanding page description language (PDL) code data into raster image data, a boot sequence, font information, and the like.

A RAM 208 stores image data that has been sent from the scanner unit 201 or the external I/F unit 202. In addition, the RAM 208 stores various programs that were stored in the ROM 207 as well as setting information. Moreover, the RAM 208 stores information related to the sheet processing apparatus 200. For example, the RAM 208 stores information on the number of the sheet-processing apparatuses connected to the printing apparatus 100 (from 0 to n), information on the function of each of the sheet processing apparatuses 200*a*, 200*b*, . . . , 200*n*, information on the connection order of the sheet processing apparatuses 200*a*, 200*b*, . . . , 200*n*, and the like.

A hard disk drive (HDD) 209 is made up of a hard disk, a drive unit, and the like. The drive unit writes data into the hard disk and reads data out of the hard disk. The HDD 209 is a large-capacity memory device that can store a large volume of data. The HDD 209 stores image data that has been outputted from the scanner unit 201 or the external I/F unit 202 and then has been compressed at a compression/decompression unit 210. Under the control of the controller unit 205, the printer unit 203 can print out image data that is stored in the HDD 209 in accordance with user instructions. In addition to such a print control function/capability, the controller unit 205 can transmit image data that is stored in the HDD 209 to an external device such as the PC 103 or the like via the external I/F unit 202 in accordance with user instructions.

The compression/decompression unit 210 performs compression/decompression processing on image data or the like that is stored in the RAM 208 and the HDD 209 in conformity with a JBIG compression/decompression format, a JPEG compression/decompression format, or other various compression/decompression formats.

Figure 3:
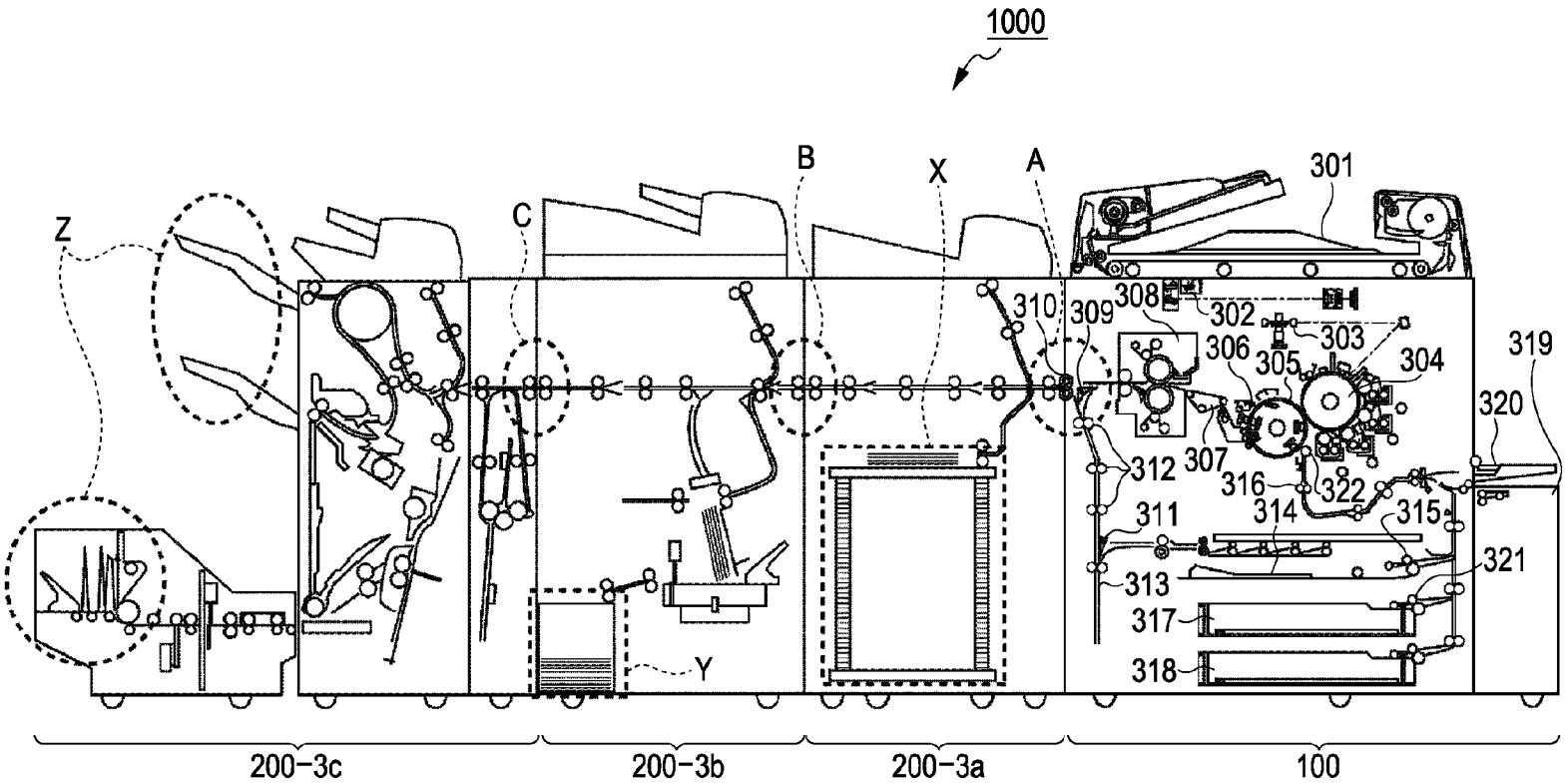
FIG. 3 is a diagram that schematically illustrates, in a sectional view, an example of the configuration of the printing system 1000 according to an embodiment of the invention.

Next, the configuration of the printing system 1000 is further explained below while referring to the sectional view of FIG. 3. FIG. 3 is a sectional view that schematically illustrates an example of the configuration of the printing apparatus 100 and the sheet processing apparatus 200, which is connected to the printing apparatus 100, according to an exemplary embodiment of the invention.

Having a CCD sensor, a scanner 302 scans a sheet of original document that has been conveyed onto the glass of a document plate and then converts the scanned image into image data. A rotatable polygon mirror 303 receives an incident beam of light such as a laser beam subjected to modulation on the basis of image data. The light is reflected at a reflecting mirror and then is irradiated as reflected scan light onto a photosensitive drum 304. A latent image that is formed on the photosensitive drum 304 by the laser beam is developed with the use of toner. A toner image is then transferred onto a sheet of print target medium that is held on an image-transfer drum 305. A series of image forming processes explained above is executed for each of yellow (Y) toner, magenta (M) toner, cyan (C) toner, and black (K) toner in a sequential manner so as to form a full color image. After the execution of the series of image forming processes four times, the sheet on which the full-color image has been formed is separated from the image-transfer drum 305 by a separation pawl 306. A pre-fixation conveyor 307 conveys the separated sheet to a fixing device 308. The fixing device 308 is configured as a combination of rollers and belts. The fixing device 308 has a built-in heat source such as a halogen heater or the like. The fixing device 308 fuses the toner of the toner image that has been transferred onto the sheet by applying heat and pressure thereto so as to fix the image thereon. A paper ejection flapper 309, which can pivot on a pivot shaft, determines the conveying direction of a sheet of print target medium. When the paper ejection flapper 309 moves in a clockwise direction (refer to FIG. 3), the sheet is conveyed in a straight orientation and thus ejected out of the printing apparatus 100 through a pair of paper ejection rollers 310.

The controller unit 205 controls the operation of the printing apparatus 100 so as to perform single-side printing through a series of sequences described above.

On the other hand, when an image is to be formed on both sides of a sheet of paper, the paper ejection flapper 309 moves in a counterclockwise direction (refer to FIG. 3). As a result thereof, the conveying direction of the sheet is changed into a downward direction so that the sheet is fed into a double-side printing conveyor unit. The double-side printing conveyor unit is provided with a reversing flapper 311, pairs of reversing rollers 312, a reversing guide 313, and a double-side printing tray 314. A reversing flapper 311 pivots on a pivot shaft. The reversing flapper 311 determines the conveying direction of a sheet of paper. When the controller unit 205 processes a duplex printing job, the controller unit 205 performs control on the traveling of a sheet of paper as follows. The reversing flapper 311 moves in a counterclockwise direction. The sheet having a first side on which an image has already been printed at the printer unit 203 is fed to the reversing guide 313 through the pairs of reversing rollers 312. Then, the operation of the reversing rollers 312 are temporarily stopped while the rear end of the sheet is held between the pair of reversing rollers 312. Subsequently, the controller unit 205 controls the reversing flapper 311 so that it moves in a clockwise direction. In addition, the controller unit 205 controls the reversing rollers 312 so that they turn in the reverse direction. As a result thereof, the sheet is switched back for further conveyance. The controller unit 205 controls the conveyance of the sheet so that it is guided onto the double-side printing tray 314 with the original rear end of the sheet being the front end thereof after the switchback. The sheet is temporarily stacked thereon at the double-side printing tray 314. Thereafter, the sheet is fed again to a pair of registration rollers 316 by a re-feeding roller 315. In this reverse-side image transfer processing, a second side of the sheet that is opposite to the first side thereof faces the photosensitive drum 304. Then, a second-side image is formed on the second side of the sheet through the same process as that explained above. After images have been formed on both sides of the sheet, which is followed by an image fixation process, the sheet is ejected out of the main body of the printing apparatus 100 through the pair of paper ejection rollers 310. Through a series of sequences described above, the controller unit 205 controls the operation of the printing apparatus 100 so as to perform double-side printing.

The printing apparatus 100 has a plurality of paper-feeding units in each of which a plurality of sheets can be provided for print processing. Examples of paper-feeding units are paper-feeding cassettes 317 and 318, a paper-feeding deck 319, and a manual paper-feeding tray 320, though not limited thereto. For example, each of the paper-feeding cassettes 317 and 318 has a paper stock capacity of 500 sheets. The paper-feeding deck 319 has, for example, a paper stock capacity of 5000 sheets. Various kinds of sheets that are different in size and material from one another can be provided on the paper-feeding cassettes 317, 318 and the paper-feeding deck 319 on a feeding-unit-by-feeding-unit basis. Various kinds of sheets that include special sheets such as an OHP sheet or the like can be set on the manual paper-feeding tray 320. Each of the paper-feeding cassettes 317, 318, the paper-feeding deck 319, and the manual paper-feeding tray 320 has a paper-feeding roller. The paper-feeding roller picks up one sheet after another for the feeding thereof.

Next, an explanation is given of the sheet processing apparatus 200 that is shown in FIG. 3.

Arbitrary number and type of apparatuses can be connected so as to make up the sheet processing apparatus 200 in the configuration of the printing system 1000 according to the present embodiment of the invention as long as a sheet of paper can be conveyed on a sheet conveying path from an upstream apparatus to a downstream apparatus. For example, as illustrated in FIG. 3, a large-capacity stacker 200-3*a*, a gluing machine 200-3*b*, and a saddle-stitching machine 200-3*c* are connected in the order of appearance herein when viewed from the printing apparatus 100 with the large-capacity stacker 200-3*a* being closest to the printing apparatus 100. These sheet-processing apparatuses 200-3*a*, 200-3*b*, and 200-3*c* can be selectively used in the configuration of the printing system 1000. Each of the sheet processing apparatuses 200-3*a*, 200-3*b*, and 200-3*c* has a sheet ejection unit. A user can take processed sheets out of the sheet ejection unit of each sheet processing apparatus.

Among a plurality of sheet-processing job candidates that can be executed at the sheet processing apparatuses 200 connected to the printing apparatus 100, the controller unit 205 accepts a request for the execution of a certain sheet-processing job demanded by a user via the operation unit 204 together with a request for the execution of a printing job. Then, upon the reception of a request for the execution of printing for a processing-target job via the operation unit 204, the controller unit 205 causes the printer unit 203 to execute print processing that is required by the job. Thereafter, the controller unit 205 performs control so that the printed sheet for the job is conveyed to one sheet processing apparatus that can execute a type of sheet processing that is demanded by the user over the sheet conveying path. Then, the controller unit 205 causes the sheet processing apparatus 200 to execute the demanded sheet processing.

For example, when the printing system 1000 has a system configuration illustrated in FIG. 3, it is assumed herein that the processing-target job for which a print execution request has been received from a user is a job for stacking a number of sheets, which is to be executed by the large-capacity stacker 200-3a. This job is hereafter referred to as a "stacker job".

When the printing system 1000 that has a system configuration illustrated in FIG. 3 processes a stacker job, the controller unit 205 performs control so that sheets on which printing has been performed at the printing apparatus 100 should be conveyed into the large-capacity stacker 200-3*a* through the point A shown in FIG. 3. Thereafter, the controller unit 205 causes the large-capacity stacker 200-3*a* to execute the stacking processing of this job. Then, the controller unit 205 performs control so that the printed sheets that have been stacked at the large-capacity stacker 200-3*a* to be held at the paper ejection port X inside the large-capacity stacker 200-3*a* without any further conveyance of the stacked sheets to other machine (e.g., a downstream apparatus).

The user can directly take out the stacked sheets, that is, the print output of the stacker job, which is held at the paper ejection port X shown in FIG. 3. By this means, it is possible to make it unnecessary for the apparatus to perform a series of operations so as to convey the stacked sheets to the most downstream paper ejection port Z shown in FIG. 3 when viewed in the sheet-conveying direction. In addition, it is possible to make it unnecessary for the user to take out the stacked sheets at the most downstream paper ejection port Z.

As a next example, when the printing system 1000 has a system configuration illustrated in FIG. 3, it is assumed herein that the processing-target job for which a print execution request has been received from a user is a job instructing sheet processing that is to be executed by the gluing machine 200-3*b* (e.g., gluing processing such as case binding or book block binding). This job is hereafter referred to as a "gluing job".

When the printing system 1000 that has a system configuration illustrated in FIG. 3 processes a gluing job, the controller unit 205 performs control so that sheets on which printing has been performed at the printing apparatus 100 should be conveyed into the gluing machine 200-3*b* through the points A and B shown in FIG. 3. Thereafter, the controller unit 205 causes the gluing machine 200-3*b* to execute the gluing processing of this job. Then, the controller unit 205 performs control so that the printed sheets that have been subjected to gluing at the gluing machine 200-3*b* are held at the paper ejection port Y inside the gluing machine 200-3*b* without any further conveyance of the glue-processed sheets to other machine (e.g., a downstream apparatus).

As another example, when the printing system 1000 has a system configuration illustrated in FIG. 3, it is assumed herein that the processing-target job for which a print execution request has been received from a user is a job instructing sheet processing that is to be executed by the saddle-stitching machine 200-3*c*. The sheet processing to be executed by the saddle-stitching machine 200-3*c* includes, for example, saddle stitching, punching, trimming, shift ejection, and folding. This job is hereafter referred to as a "saddle-stitching job".

When the printing system 1000 that has a system configuration illustrated in FIG. 3 processes a saddle-stitching job, the controller unit 205 performs control so that sheets on which printing has been performed at the printing apparatus 100 should be conveyed into the saddle-stitching machine 200-3*c* through the points A, B, and C. Thereafter, the controller unit 205 causes the saddle-stitching machine 200-3*c* to execute the sheet processing of this job. Then, the controller unit 205 performs control so that the printed sheets that have been subjected to sheet processing at the saddle-stitching machine 200-3*c* are held at the paper ejection port Z inside the saddle-stitching machine 200-3*c*.

Note that there is a plurality of paper-eject candidates for the paper ejection port Z. Since the saddle-stitching machine 200-3*c* can execute plural types of sheet processing, a dedicated paper ejection port is provided for each type of sheet processing.

As explained above while referring to FIGS. 1, 2, and 3, a plurality of sheet processing apparatuses can be connected to the printing apparatus 100 in the configuration of the printing system 1000 according to the present embodiment of the invention. The plurality of sheet processing apparatuses can be connected to the printing apparatus 100 in any combination. The connection order of the plurality of sheet processing apparatuses can be modified freely as long as a sheet-conveying path from one sheet processing apparatus to another is continuous. Furthermore, there are plural candidates of sheet processing apparatuses that can be connected to the printing apparatus 100.

Next, the configuration of the operation unit 204 is explained below while referring to FIG. 4.

The operation unit 204 is provided with a touch panel unit 401 and a key input unit 402.

The touch panel unit 401 is made up of a liquid crystal display (LCD) and a transparent electrode that is provided on the LCD. The touch panel unit 401 displays various setting screens for receiving instructions from a user. The touch panel unit 401 has a display function for displaying various screens and a user-input function for receiving instructions given by a user.

The key input unit 402 is provided with a power key 403, a stop key 404, a start key 405, a reset key 406, a user mode key 407, a ten key unit 408, a clear key 409, and an ID key 410.

The power key 403 is a key for switching modes between a standby mode (i.e., a normal operation state) and a sleep mode (i.e., a power-saving state in which programs are stopped to wait for interruptions for network printing, facsimile, and the like).

The start key 405 is a key for starting a job that is instructed by a user. For example, the start key 404 is used for starting an original document copy job, a data transmission job, and the like. The stop key 404 is a key for stopping the processing of a job once started.

The ten key unit 408 is a key unit for allowing a user to input numeric values for setting the number of print copies to be made, entering a password, or the like. The user mode key 407 is a key for proceeding to a system setting screen on which a user can set the type of paper that is set on a paper-feeding unit or change time that is managed by the printing system 1000.

The touch panel unit 401 has a sheet processing setting key and an application mode key. The sheet processing setting key is a key for setting sheet processing performed by the sheet processing apparatus 200. The application mode key is a key for setting the printing of page numbers, setting the layout of a document to be copied, and the like.

Figure 5:
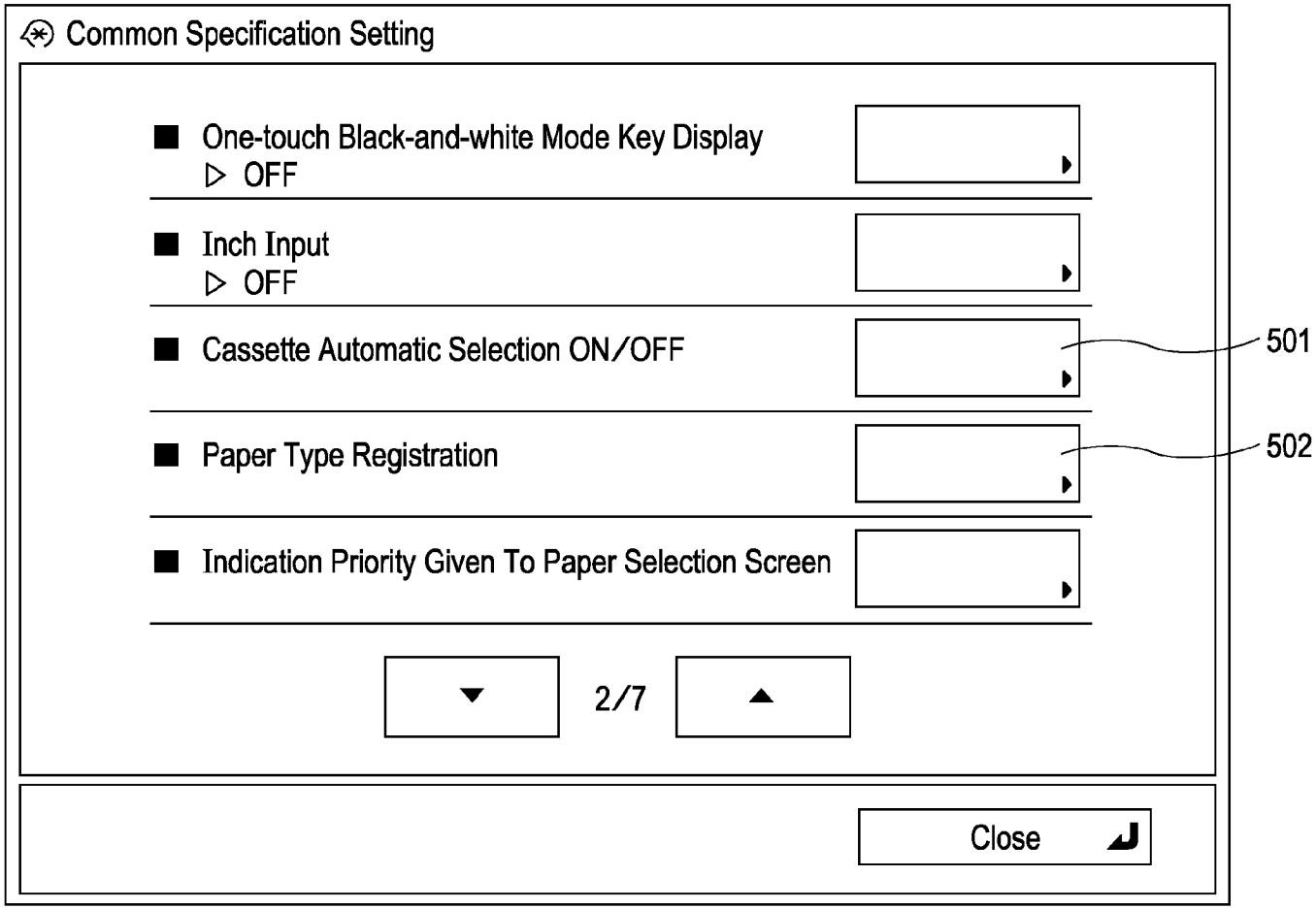
FIG. 5 is a diagram that schematically illustrates an example of a screen that is displayed on the touch-panel section of the operation unit 204 according to an embodiment of the invention.

FIG. 5 is an example of a screen that is displayed on the touch panel unit 401 by the controller unit 205 when a user has pressed down the user mode key 407. A user can select one button among a plurality of buttons displayed on the screen so as to make the corresponding one of various setting screens appears as a user interface.

Figure 6:
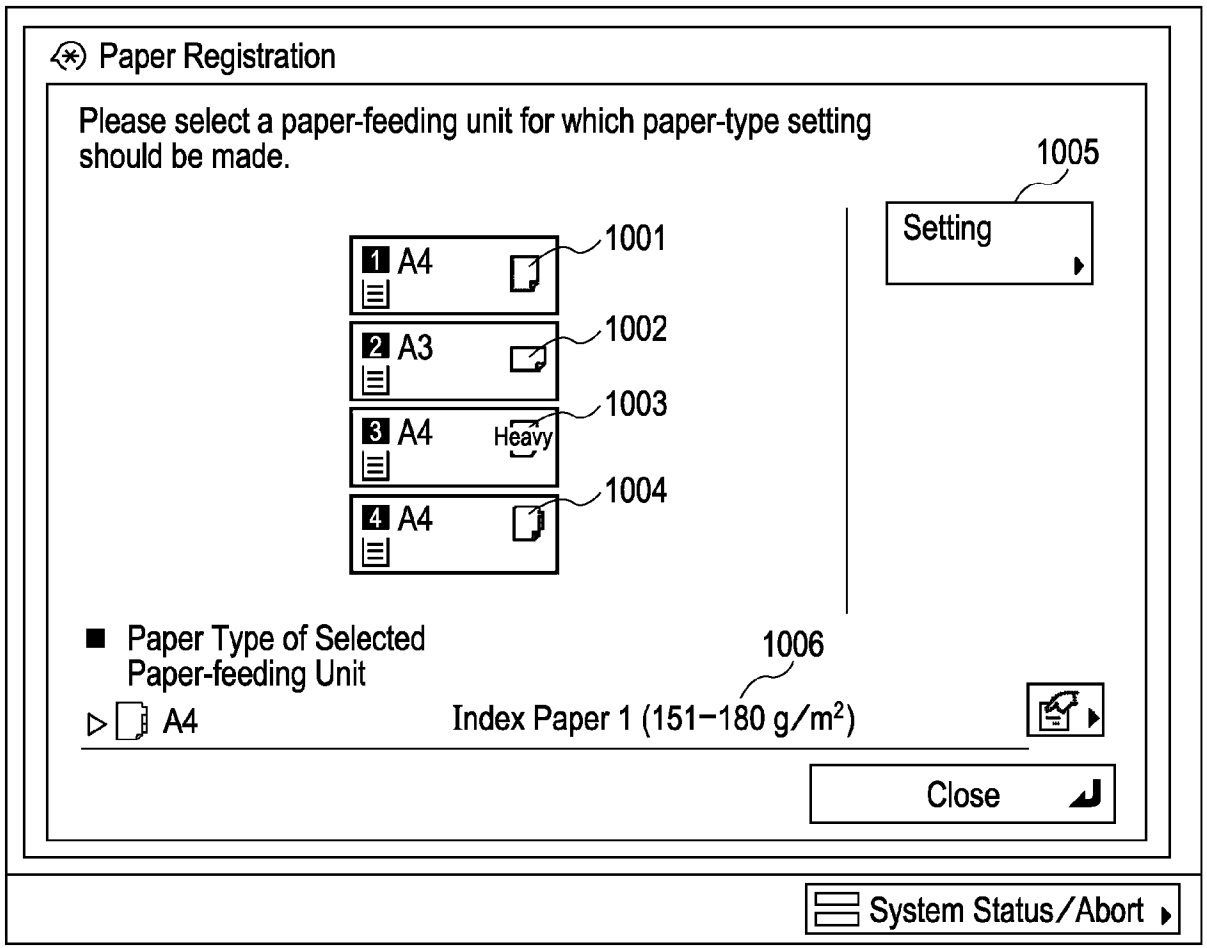
FIG. 6 is a diagram that schematically illustrates an example of a screen that is displayed on the touch-panel section of the operation unit 204 according to an embodiment of the invention.

FIG. 6 is a screen for selecting a paper-feeding unit of the printing system 1000 for which the setting of the type of paper is to be made. When a "paper type registration" button 502 shown in FIG. 5 is pressed down, the controller unit 205 displays the screen shown in FIG. 6 on the touch panel unit 401.

The printing system 1000 is provided with the paper-feeding cassettes 317, 318, the paper-feeding deck 319, and the manual paper-feeding tray 320 as paper-feeding units in each of which a plurality of sheets can be set for print processing. Paper-feeding unit buttons 1001, 1002, 1003, and 1004 shown in FIG. 5 correspond to the paper-feeding cassette 317, the paper-feeding cassette 318, the paper-feeding deck 319, and the manual paper-feeding tray 320, respectively. Information such as the size of paper that is currently set, the orientation of the paper, and the type of the paper is displayed on each of the paper-feeding unit buttons 1001-1004.

Among the plurality of paper-feeding unit buttons that correspond to the plurality of paper-feeding units of the printing apparatus 100, a user presses one paper-feeding unit button shown on the touch panel that corresponds to one paper-feeding unit for which they want to make the setting of a paper type. The selected paper-feeding unit button is highlighted. The size of paper that is set in the selected paper-feeding unit as well as related information on the paper is displayed in a display area 1006.

When a setting button 1005 is pressed while one of the paper-feeding unit buttons 1001, 1002, 1003, and 1004 is being selected, the controller unit 205 displays a screen for setting the size of paper, the material of paper, and the like on the touch panel unit 401.

Figure 7:
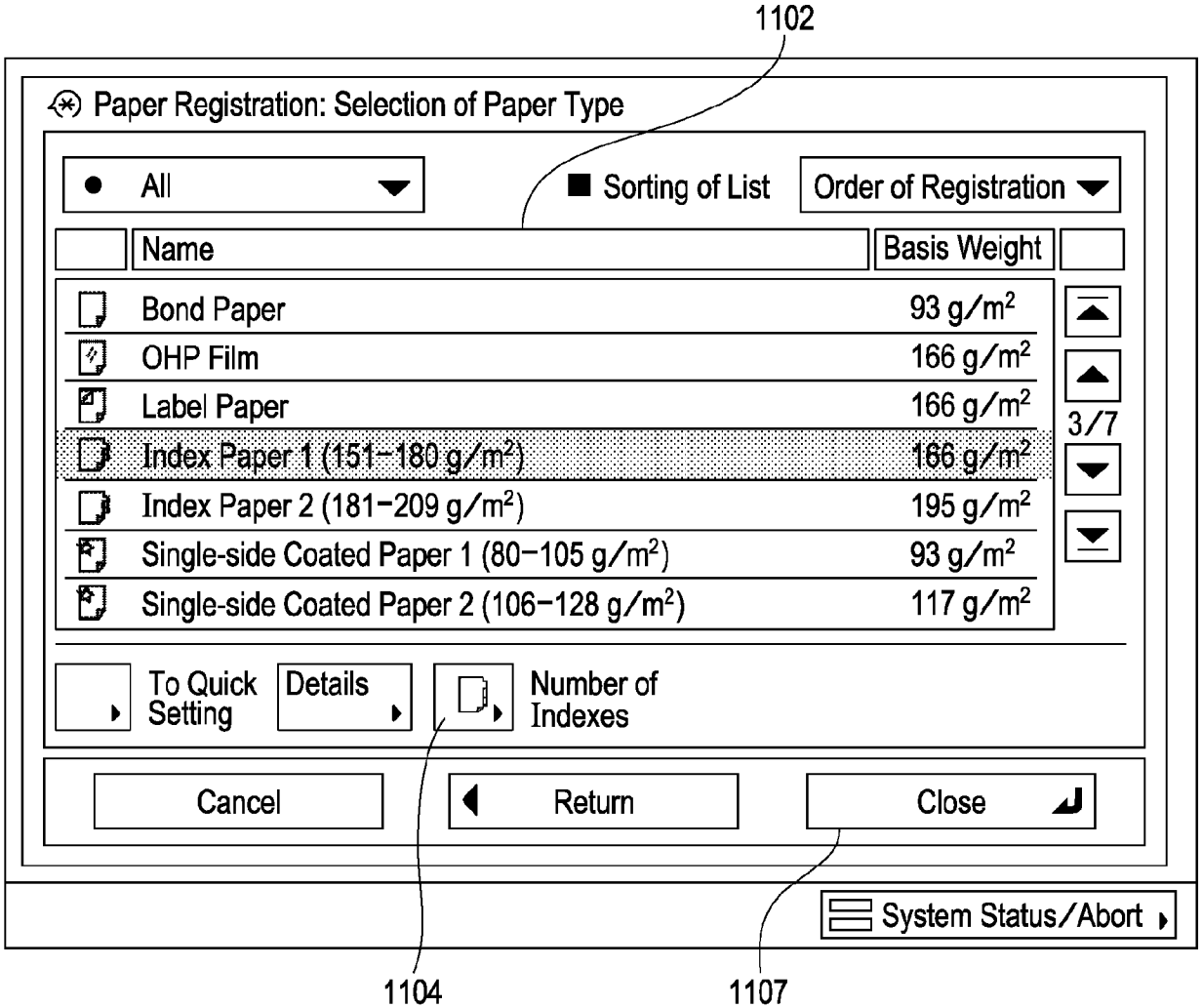
FIG. 7 is a diagram that schematically illustrates an example of a screen that is displayed on the touch-panel section of the operation unit 204 according to an embodiment of the invention.

FIG. 7 is a screen for setting the size of paper, the material of paper, and the like for the paper-feeding unit that has been selected on the screen shown in FIG. 6.

When a "Close" key 1107 is pressed while one paper type among a plurality of paper types displayed on a list 1102 shown in the screen of FIG. 7 is being selected, the controller unit 205 reads information on the selected paper out of the ROM 207. Then, the controller unit 205 stores, in association with the paper-feeding unit that has been selected in the screen of FIG. 6, the read information on the paper into a paper-feeding unit information table that is stored in the RAM 208.

When either "index paper 1 (151-180 g/m$^2$)" or "index paper 2 (181-209 g/m$^2$)" is selected out of the list 1102 shown in the screen of FIG. 7, the controller unit 205 causes an index-number button 1104, which means a button for setting the number of indexes, to be displayed in an enabled manner.

When the user presses the index-number button 1104, the controller unit 205 causes the touch panel unit 401 to display a screen for allowing the user to input the number of index sheets for one set.

Figure 8:
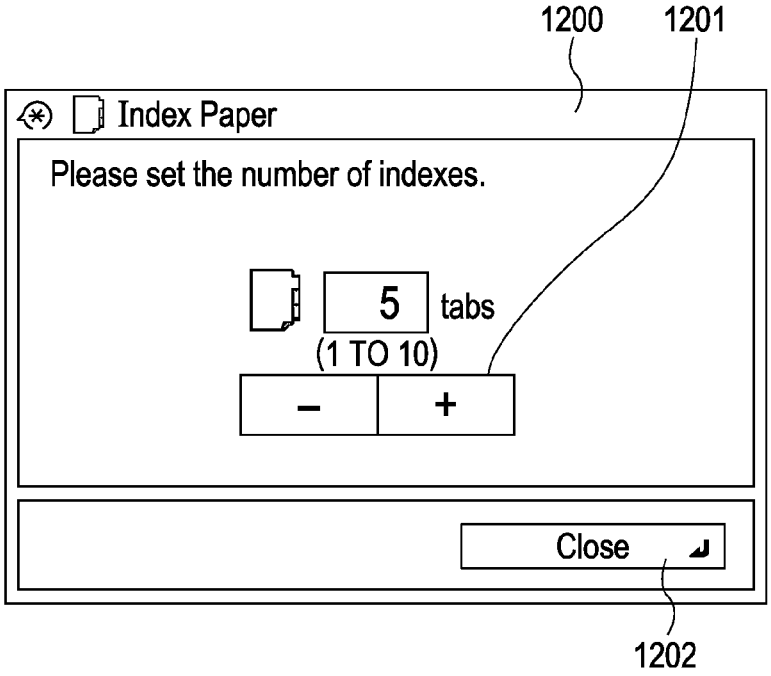
FIG. 8 is a diagram that schematically illustrates an example of a screen that is displayed on the touch-panel section of the operation unit 204 according to an embodiment of the invention.

FIG. 8 is an example of a screen for inputting the number of index sheets for one set. For example, one set of index sheets shown in FIG. 14, which is made up of five sheets, has first, second, third, fourth, and fifth tabs. The number of index sheets corresponding to one set of tabs is not limited to five but may be any plural number. A user can decrement/increment the number of index sheets for one set by pressing a "–/+" key 1201 on a screen 1200. Upon the pressing of a Close key 1202, the user can determine the number of index sheets for one set that are set in the paper-feeding unit. Upon the pressing of the Close key 1202 for the determination of the number of index sheets for one set, the controller unit 205 stores information indicating the determined number of index sheets for one set into the paper-feeding unit information table of the RAM 208 in association with information on the paper-feeding unit that has been selected in the screen of FIG. 6.

FIG. 9 is an example of a paper-feeding unit information table that is stored in the ROM 208. A paper-feeding unit information table 1301 stores, for each paper-feeding unit, paper size 1304, name 1305, basis weight 1306, feature 1307, surface nature 1308, and number of tabs (i.e., number of indexes) 1309. When selecting a paper-feeding unit that is used for printing, the controller unit 205 refers to information stored in the paper-feeding unit information table 1301. For example, when a job for printing an image on A4 plain paper is executed, the controller unit 205 looks up the paper-feeding unit information table 1301. The name 1305 is set as plain paper for each of the paper-feeding deck 319 and the manual paper-feeding tray 320. The paper size 1304 is set as A4 for each of the paper-feeding deck 319 and the manual paper-feeding tray 320. Accordingly, the controller unit 205 selects either the paper-feeding deck 319 or the manual paper-feeding tray 320 as a paper-feeding unit that is used for printing. A user may have predetermined which of these two paper-feeding units, that is, either the paper-feeding deck 319 or the manual paper-feeding tray 320, is selected for the execution of the printing job. Or, the controller unit 205 may automatically select a paper-feeding unit in which a larger amount of sheets is set.

In the following description, a method for detecting the remaining amount of sheets in each paper-feeding unit of the printing system 1000 is explained.

The controller unit 205 detects the remaining amount of sheets in a paper-feeding unit as follows.

It is assumed herein that a user has opened the paper-feeding cassette 317 in order to replenish paper. Upon the opening of the paper-feeding cassette 317, a lifter 324 moves downward until it is brought into contact with the bottom of the paper-feeding cassette 317. Then, the user sets sheets on the lifter 324 for the replenishing of paper into the paper-feeding unit. Thereafter, upon the closing of the paper-feeding cassette 317 by the user, the lifter 324 moves upward so that the uppermost one of the replenished sheets is brought into contact with a paper-feeding roller 321. A sensor 323 that is mounted on the paper-feeding cassette 317 calculates the amount of time required for the lifter 324 to return to its original position after the start of downward movement for the replenishing of paper. By this means, the sensor 323 detects the height of sheets set on the lifter 324. That is, the sensor 323 detects the amount of sheets stacked on the lifter 324.

On the basis of the paper-height information (i.e., stack-amount information), and further on the basis of information on paper that is stored in a paper-feeding unit information table (e.g., paper type, basis weight, surface nature, shape, or the like), the controller unit 205 estimates the number of sheets that remain in the paper-feeding unit.

With the number of remaining sheets being estimated, the printer unit 203 starts printing operations upon the reception of printing instructions from the controller unit 205. Then, each time when printing is performed for one sheet of paper, the controller unit 205 decrements the estimated number of sheets that remain in the paper-feeding unit by one. The printer unit 203 detects whether the amount of sheets that remain in the paper-feeding cassette 317 has reached a predetermined amount or not. Then, the printer unit 203 notifies the result of detection to the controller unit 205.

It is detected whether the amount of sheets that remain in the paper-feeding cassette 318 and the paper-feeding deck 319 has reached a predetermined amount or not by means of sensors 325 and 327, respectively, in the same manner as before. Then, each result of detection is notified to the controller unit 205.

The printer unit 203 picks up a sheet that is set on the paper-feeding cassette 317 by operating the pickup roller 321 while moving the lifter 324. It is assumed herein that the pickup roller 321 has failed to pick up a sheet of paper from the paper-feeding cassette 317 although the lifter 324 has been moved to a position at which paper pickup is supposed to be performed. Upon the occurrence of such a pickup failure, the printer unit 203 detects the absence of paper in the paper-feeding cassette 317. Then, the printer unit 203 notifies the result of detection to the controller unit 205.

Through the same processing as that explained above, the printer unit 203 detects the absence of paper in the paper-feeding cassette 318, the paper-feeding deck 319, and the manual paper-feeding tray 320. Then, the printer unit 203 notifies the result of detection to the controller unit 205.

The controller unit 205 detects the remaining amount of sheets in each paper-feeding unit through the procedure explained above.

Figure 10:
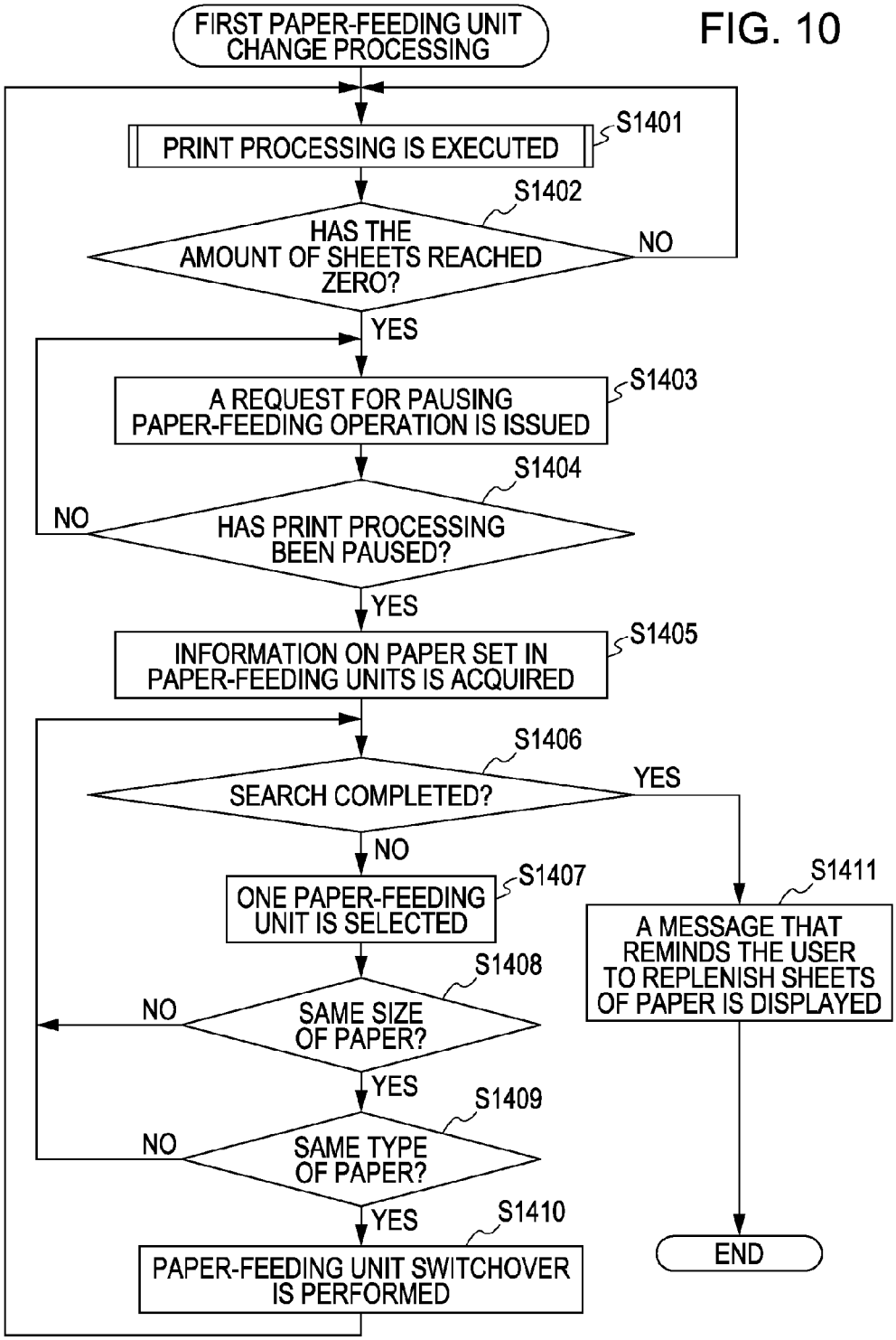
FIG. 10 is a flowchart that schematically illustrates a data processing procedure according to an exemplary embodiment of the invention.
Figure 11:
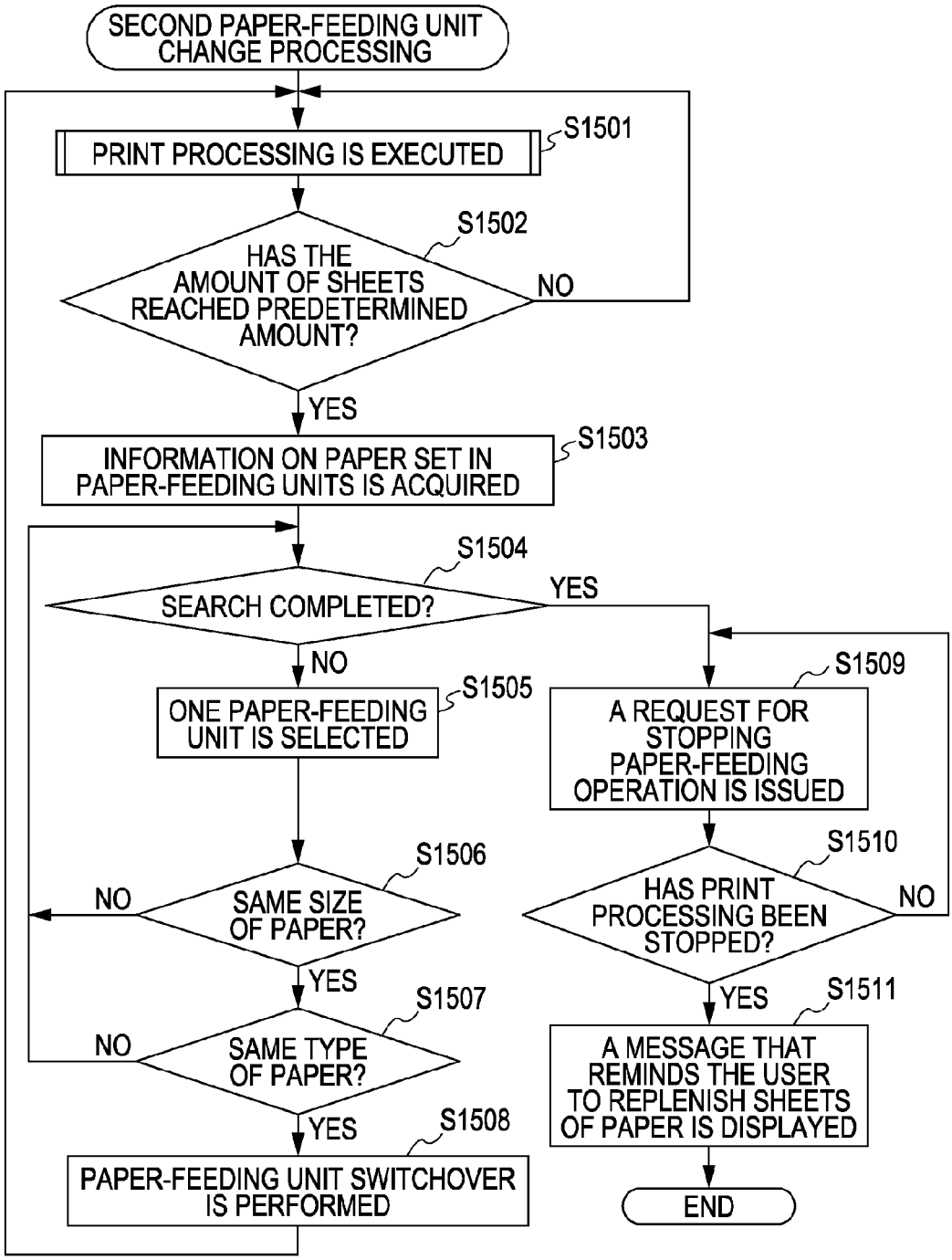
FIG. 11 is a flowchart that schematically illustrates a data processing procedure according to an exemplary embodiment of the invention.

Next, with reference to FIGS. 10 and 11, processing for changing paper-feeding units that is performed by the controller unit 205 is explained. The controller unit 205 can perform two types of paper-feeding unit change processing.

FIG. 10 is a diagram that schematically illustrates an example of first paper-feeding unit change processing performed by the controller unit 205 according to the present embodiment of the invention. The first paper-feeding unit change processing is performed so as to switch from one paper-feeding unit to another when the absence of paper in the above-mentioned one paper-feeding unit is detected.

FIG. 11 is a diagram that schematically illustrates an example of second paper-feeding unit change processing performed by the controller unit 205 according to the present embodiment of the invention. The second paper-feeding unit change processing is performed so as to switch from one paper-feeding unit to another when it is detected that the amount of paper that is in the above-mentioned one paper-feeding unit has reached a predetermined amount, which is not zero.

Each of the first paper-feeding unit change processing shown in FIG. 10 and the second paper-feeding unit change processing shown in FIG. 11 is performed by the controller unit 205 through the execution of a program that is stored in the ROM 207.

Figure 12:
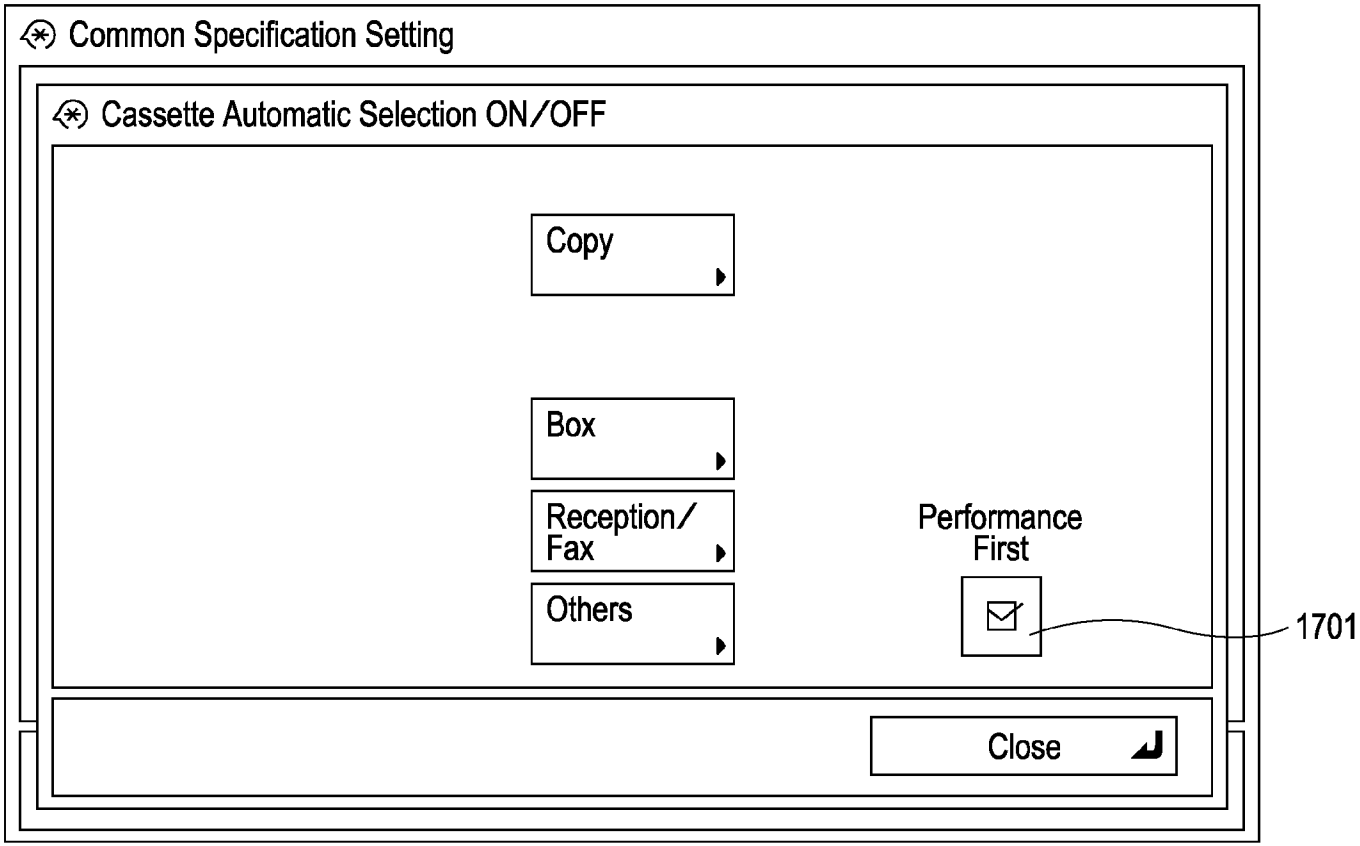
FIG. 12 is a diagram that schematically illustrates a screen that is displayed on the touch-panel section of the operation unit 204 according to an exemplary embodiment of the invention.

In addition, a user can select which of these two paper-feeding unit change processing is performed, that is, either the first paper-feeding unit change processing shown in FIG. 10 or the second paper-feeding unit change processing shown in FIG. 11, is to be performed by the printing apparatus 100 on a setting screen shown in FIG. 12. FIG. 12 is an example of a screen that is displayed on the touch panel unit 401 by the controller unit 205 when a user has pressed a "cassette automatic selection ON/OFF button" 501 shown in the screen of FIG. 5.

A user can set a "great importance is placed on productivity" button 1701 ON/OFF in the setting screen shown in FIG. 12. In the following description, the "great importance is placed on productivity" button 1701 is referred to as "performance first" button 1701 for simplicity. If the window shown in FIG. 12 is closed with the "performance first" button 1701 being set OFF, the controller unit 205 performs control so that the first paper-feeding unit change processing shown in FIG. 10 should be executed in the course of print processing. On the other hand, if the window shown in FIG. 12 is closed with the "performance first" button 1701 being set ON, the controller unit 205 performs control so that the second paper-feeding unit change processing shown in FIG. 11 should be executed in the course of print processing.

The first paper-feeding unit change processing is explained below with reference to FIG. 10.

Figure 4:
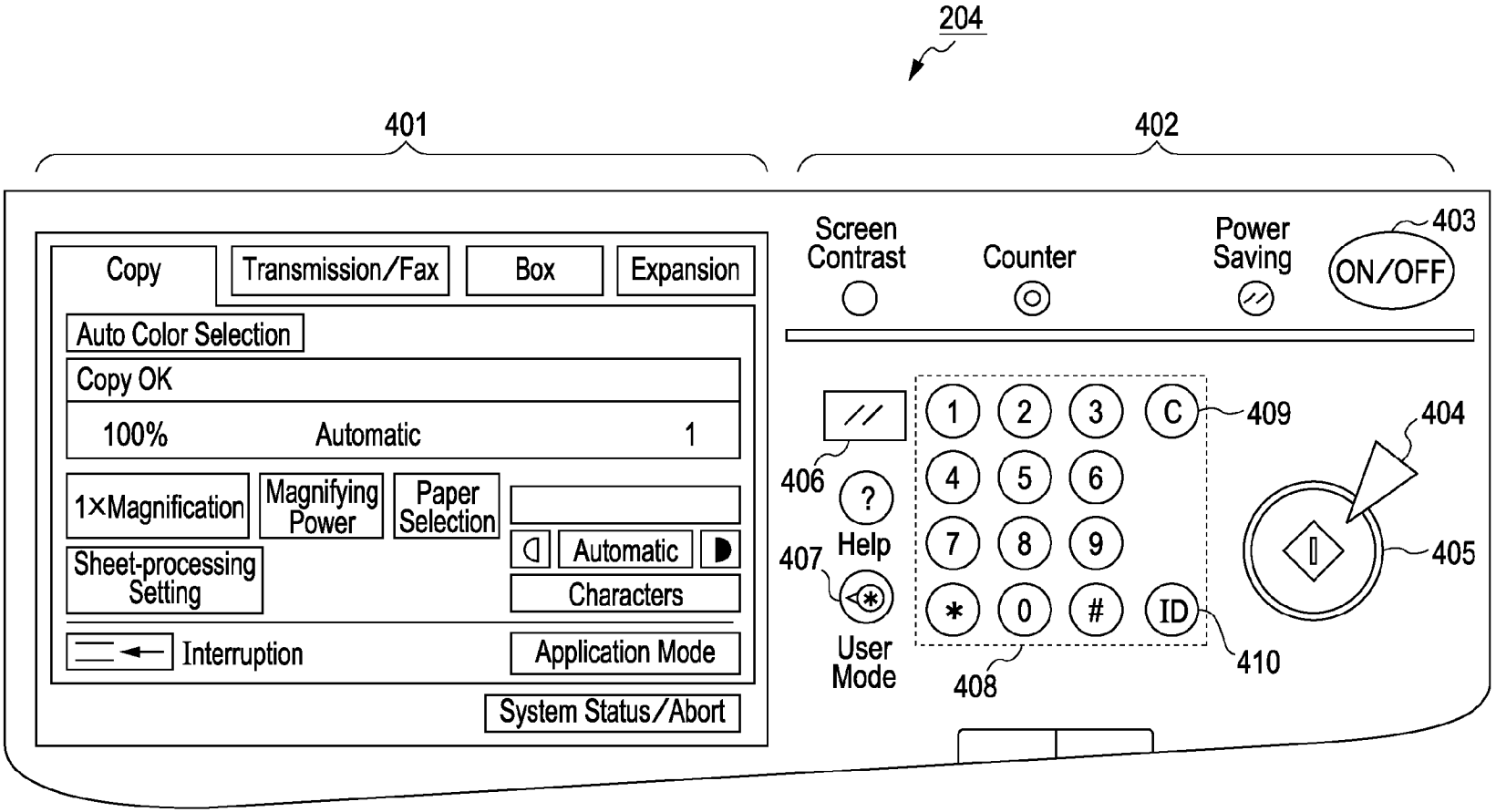
FIG. 4 is a diagram that schematically illustrates an example of the hard-key configuration of an operation unit 204 according to an embodiment of the invention, which is shown together with a user interface screen displayed on the touch-panel section thereof.

First, after configuring various settings through the manipulation of various keys shown in the touch panel unit 401 of the operation unit 204 shown in FIG. 4, a user presses a start key 503 so as to instruct the execution of a job.

When the start key 503 is pressed, the controller unit 205 executes print processing for a job in S1401. The job may be a copy job in which image data is scanned by the scanner unit 201 and then printed out. Or, the job may be a print job in which image data that has been received from the PC 103 or the PC 104 is printed out.

If the job is a copy job, the controller unit 205 causes the scanner unit 201 to scan a sheet of original document and further causes the printer unit 203 to execute the print processing of this job while the scanned data is processed at the compression/decompression unit 210 and then stored in the HDD 209. In order to execute the print processing of this job, the controller unit 205 determines a paper-feeding unit that is to be used for printing on the basis of printing conditions that have been set by the user through the manipulation of the operation unit 204 or the operation unit of the PC 103 or the PC 104. The controller unit 205 performs control so that a sheet of paper is picked up from the determined paper-feeding unit. Then, the controller unit 205 causes the printer unit 203 to perform print processing thereon. For example, on the basis of the size and type of paper set by the user, the controller unit 205 finds a paper-feeding unit that has paper-size property and paper-type property agreeing therewith. The controller unit 205 performs control so that a sheet of paper is picked up from the determined paper-feeding unit. Then, the controller unit 205 causes the printer unit 203 to perform print processing thereon.

During the execution of such print processing, the controller unit 205 makes a judgment as to whether the amount of sheets that are set in the paper-feeding unit that is being used for the print processing of this job has reached zero or not on the basis of information sent from the printer unit 203 in S1402. That is, in S1402, the controller unit 205 judges whether the paper-feeding unit has run out of sheets or not. If the controller unit 205 judges that the amount of sheets that are set in the paper-feeding unit that is being used for the print processing of this job has not reached zero yet, the controller unit 205 returns the operations to S1401. As a result thereof, the controller unit 205 causes the print processing of this job to be continued without switching from this paper-feeding unit. That is, the use of this paper-feeding unit is continued. On the other hand, if it is judged that the amount of sheets that are set in the paper-feeding unit that is being used for the print processing of this job has reached zero, the operations proceed from S1402 to S1403.

As explained above, in the first paper-feeding unit change processing, the printer unit 203 sends a notification indicating that the paper-feeding unit that is being used for print processing has run out of sheets to the controller unit 205. Upon the reception of such a notification by the controller unit 205, the operations proceed from S1402 to S1403. Then, the controller unit 205 sends a request for pausing the paper-feeding operation to the printer unit 203. Upon the reception of such a paper-feeding operation pause request, the printer unit 203 pauses the paper-feeding operation. When the print processing is paused, the controller unit 205 causes all sheets on which printing has already been performed to be ejected to a designated paper ejection port.

In S1404, the controller unit 205 makes a judgment as to whether print processing has already been paused or not. If it is judged that print processing has already been paused, the operations proceed from S1404 to S1405. If it is judged that print processing has not been paused yet, the controller unit 205 returns the operations to S1403 so as to wait for the pausing of print processing. Upon the detection of the pausing of print processing, the process moves on to S1405.

In S1405, the controller unit 205 acquires information on paper that is set in paper-feeding units of the printing system 1000 from the paper-feeding unit information table 1301 that is stored in the ROM 208. Such information on paper includes the size and type thereof. Then, the controller unit 205 performs a series of processing shown as S1406-S1410 for each of the plurality of paper-feeding units listed on the paper-feeding unit information table 1301 so as to search for a substitute paper-feeding unit that can take over the paper-feeding operation for resuming print processing.

At the start of a loop, the controller unit 205 makes a judgment in S1406 as to whether subsequent processing of S1407, S1408, and S1409 has already been performed for all paper-feeding units or not. If it is judged in S1406 that the subsequent processing of S1407, S1408, and S1409 has not been performed yet for one or more paper-feeding unit, in S1407, the controller unit 205 selects any one paper-feeding unit among the paper-feeding units for which the subsequent processing has not been performed yet (herein it is assumed that the subsequent processing has not been performed for more than one paper-feeding unit) as a judgment-target paper-feeding unit for which judgments of S1408 and S1409 are to be executed.

In S1408, the controller unit 205 compares the size of paper that is set in the paper-feeding unit that has been selected in S1407 with the size of paper that is set in the paper-feeding unit for which it was detected in the previous S1402 that the amount of sheets set therein had reached zero. If it is judged in S1408 that the size of paper that is set in the paper-feeding unit selected in S1407 does not agree with that of the paper-feeding unit for which it was detected in the previous S1402 that paper had run out, the controller unit 205 returns the operations from S1408 to S1406. On the other hand, if it is judged in S1408 that the size of paper that is set in the paper-feeding unit selected in S1407 is the same as that of the paper-feeding unit for which it was detected in the previous S1402 that paper had run out, the operations proceed from S1408 to S1409.

In S1409, the controller unit 205 compares the type of paper that is set in the paper-feeding unit that has been selected in S1407 with the type of paper that is set in the paper-feeding unit for which it was detected in the previous S1402 that the amount of sheets set therein had reached zero. If it is judged in S1409 that the type of paper that is set in the paper-feeding unit selected in S1407 does not agree with that of the paper-feeding unit for which it was detected in the previous S1402 that paper had run out, the controller unit 205 returns the operations from S1409 to S1406. On the other hand, if it is judged in S1409 that the type of paper that is set in the paper-feeding unit selected in S1407 is the same as that of the paper-feeding unit for which it was detected in the previous S1402 that paper had run out, the operations proceed from S1409 to S1410.

In S1410, the controller unit 205 commands the printer unit 203 to switch from the paper-feeding unit for which it was detected that paper had run out to the paper-feeding unit selected in S1407. Then, the controller unit 205 returns the operations from S1410 to S1401. By this means, in the operation of the printing system 1000, the controller unit 205 causes the printer unit 203 to continue, after a pause, the execution of printing for the job with the use of an "after-the-change" paper-feeding unit, which is a substitute paper-feeding unit selected through the procedure explained above. This is a case where there is at least one paper-feeding unit that can take over the paper-feeding operation, which was paused in S1403, for resuming print processing for the job.

If the controller unit 205 judges in S1406 that the processing of S1407, S1408, and S1409 has been performed for all paper-feeding units in vain, the operations proceed from S1406 to S1411. In S1411, the controller unit 205 causes the operation unit 204 to display a message that prompts or reminds the user to replenish sheets of paper required for continuing the print processing for the job explained above.

Through the first paper-feeding unit change processing explained above, when paper that is set in the paper-feeding unit that is now being used for print processing has run out, the controller unit 205 performs a paper-feeding unit switchover automatically. Therefore, it is possible to resume paused print processing without any necessity for an operator to manually instruct the execution of such a switchover from one paper-feeding unit to another.

Next, the second paper-feeding unit change processing is explained below with reference to FIG. 11.

First, in S1501, the controller unit 205 performs the same processing as that of S1401 explained above while referring to FIG. 10.

During the execution of such print processing, the controller unit 205 makes a judgment as to whether the amount of sheets that are in the paper-feeding unit that is currently being used for the print processing of this job has reached a predetermined amount or not on the basis of information sent from the printer unit 203 in S1502. Note that the predetermined amount does not include zero. If the controller unit 205 judges that the amount of sheets that are set in the paper-feeding unit that is currently being used for the print processing of this job has not reached the predetermined amount yet, the controller unit 205 returns the operations to S1501. As a result, the controller unit 205 causes the print processing of this job to be continued without switching from the currently-used paper-feeding unit. That is, the use of this paper-feeding unit is continued. On the other hand, if it is judged that the amount of sheets that are set in the paper-feeding unit that is currently being used for the print processing of this job has reached the predetermined amount, the operations proceed from S1502 to S1503.

As explained above, in the second paper-feeding unit change processing, the printer unit 203 sends, to the controller unit 205, a notification indicating that the amount of sheets remaining in the paper-feeding unit that is currently being used for print processing has reached the predetermined amount. Upon the reception of such a notification by the controller unit 205, the operations proceed from S1502 to S1503. Unlike the foregoing operations shown in the flowchart of FIG. 10, however, in the second paper-feeding unit change processing described herein, the controller unit 205 performs the processing of S1503 without transmitting a request for pausing the paper-feeding operation to the printer unit 203.

In S1503, the controller unit 205 acquires information on paper that is set in paper-feeding units of the printing system 1000 from the paper-feeding unit information table 1301 that is stored in the ROM 208 while continuing, without any pause, print processing with the use of sheets of paper set in the paper-feeding unit for which it was detected in the preceding S1502 that the amount of sheets set therein had reached the predetermined amount. The information acquired in S1503 includes, for example, the size of paper and the type thereof. Then, the controller unit 205 performs a series of processing shown as S1504-S1508 for each of the plurality of paper-feeding units listed on the paper-feeding unit information table 1301 so as to search for a substitute paper-feeding unit that can take over the paper-feeding operation for continuing print processing. As explained above, in the second paper-feeding unit change processing, the controller unit 205 performs control so that a substitute paper-feeding unit should be searched for while continuing the print processing with the use of sheets of paper remaining in the "before-the-change" paper-feeding unit for which it was detected that the amount of sheets set therein had reached the predetermined amount. Therefore, it is possible to carry out a paper-feeding unit switchover without pausing the ongoing print processing.

At the start of a loop, the controller unit 205 makes a judgment in S1504 as to whether subsequent processing of S1505, S1506, and S1507 has already been performed for all paper-feeding units or not. If it is judged in S1504 that the subsequent processing of S1505, S1506, and S1507 has not been performed yet for one or more paper-feeding unit, in S1505, the controller unit 205 selects any one paper-feeding unit among the paper-feeding units for which the subsequent processing has not been performed yet (herein it is assumed that the subsequent processing has not been performed for more than one paper-feeding unit) as a judgment-target paper-feeding unit for which judgments of S1506 and S1507 are to be executed. For example, the controller unit 205 selects the paper-feeding cassette 317, the paper-feeding cassette 318, the paper-feeding deck 319, or the manual paper-feeding tray 320 as the judgment-target paper-feeding unit.

In S1506, the controller unit 205 compares the size of paper that is set in the paper-feeding unit that has been selected in S1505 with the size of paper that is set in the paper-feeding unit for which it was detected in the previous S1502 that the amount of sheets set therein had reached the predetermined amount. If it is judged in S1506 that the size of paper that is set in the paper-feeding unit selected in S1505 does not agree with that of the paper-feeding unit for which it was detected in the previous S1502 that the amount of sheets set therein had reached the predetermined amount, the controller unit 205 returns the operations from S1506 to S1504. On the other hand, if it is judged in S1506 that the size of paper that is set in the paper-feeding unit selected in S1505 is the same as that of the paper-feeding unit for which it was detected in the previous S1502 that the amount of sheets therein had reached the predetermined amount, the operations proceed from S1506 to S1507.

In S1507, the controller unit 205 compares the type of paper that is set in the paper-feeding unit that has been selected in S1505 with the type of paper that is set in the paper-feeding unit for which it was detected in the previous S1502 that the amount of sheets set therein had reached the predetermined amount. If it is judged in S1507 that the type of paper that is set in the paper-feeding unit selected in S1505 does not agree with that of the paper-feeding unit for which it was detected in the previous S1502 that the amount of sheets set therein had reached the predetermined amount, the controller unit 205 returns the operations from S1507 to S1504. On the other hand, if it is judged in S1507 that the type of paper that is set in the paper-feeding unit selected in S1505 is the same as that of the paper-feeding unit for which it was detected in the previous S1502 that the amount of sheets set therein had reached the predetermined amount, the operations proceed from S1507 to S1508.

In S1508, the controller unit 205 commands the printer unit 203 to switch from the paper-feeding unit for which it was detected that the amount of sheets set therein had reached the predetermined amount to the paper-feeding unit selected in S1505. Then, the controller unit 205 returns the operations from S1508 to S1501. By this means, in the operation of the printing system 1000, the controller unit 205 causes the printer unit 203 to continue, without any pause, the execution of printing for the job with the use of an after-the-change paper-feeding unit, which is a substitute paper-feeding unit selected through the procedure explained above. As explained above, in the second paper-feeding unit change processing, the controller unit 205 performs control so that a substitute paper-feeding unit that can take over the paper-feeding operation for continuing print processing should be searched for while continuing the print processing with the use of sheets of paper remaining in the before-the-change paper-feeding unit for which it was detected that the amount of sheets set therein had reached the predetermined amount. Therefore, through the second paper-feeding unit change processing explained above, when it is detected that the amount of paper remaining in the paper-feeding unit that is now being used for print processing has reached the predetermined amount, the controller unit 205 performs a paper-feeding unit switchover automatically. Accordingly, it is possible to carry out a paper-feeding unit switchover without pausing the ongoing print operations for the job. In addition, it is not necessary for an operator to manually instruct the execution of such a change from one paper-feeding unit to another.

If the controller unit 205 judges in S1504 that the processing of S1505, S1506, and S1507 has been performed for all paper-feeding units in vain, the operations proceed from S1504 to S1509. In S1509, the controller unit 205 sends a request for stopping the paper-feeding operation to the printer unit 203. Upon the reception of such a paper-feeding operation stop request, the printer unit 203 stops print processing. As an example of modified operation, the controller unit 205 may transmit, to the printer unit 203, such a request that print processing should be continued until the remaining sheets set in the paper-feeding unit runs out. In such modified operation, the paper-feeding operation is stopped upon the running out of the sheets set in the paper-feeding unit. When the print processing is stopped, the controller unit 205 causes all sheets on which printing has already been performed to be ejected to a designated paper ejection port.

In S1510, the controller unit 205 makes a judgment as to whether print processing has already been stopped or not. If it is judged that print processing has already been stopped, the operations proceed from S1510 to S1511. If it is judged that print processing has not been stopped yet, the controller unit 205 returns the operations to S1509 so as to wait for the stopping of print processing. Upon the detection of the stopping of print processing, the process moves on to S1511. In S1511, the controller unit 205 causes the operation unit 204 to display a message that prompts or reminds the user to replenish sheets of paper required for continuing the print processing for the job explained above.

When the judgment conditions are satisfied in both of the judgment operations S1506 and S1507 (YES), and thus when a paper-feeding unit switchover is carried out in S1508, the controller unit 205 may perform the following control. That is, in S1508, the controller unit 205 may make a judgment as to whether the remaining amount of sheets that are set in the judgment-target paper-feeding unit, which is being judged whether it can be used as the after-the-change paper-feeding unit, is larger than the predetermined amount or not. In such a modification example, the judgment-target paper-feeding unit is adopted as the after-the-change paper-feeding unit only if the remaining amount of sheets set therein is larger than the predetermined amount. With such a modification, it is possible to prevent paper-feeding unit change processing from being repeated upon the reception of a signal from the after-the-change paper-feeding unit to the effect that the remaining amount of sheets set therein has reached the predetermined amount immediately after the switchover, which places an extra processing burden on the controller unit 205. As another modification example, if there is no paper-feeding unit whose remaining amount of sheets is larger than the predetermined amount despite the fact that there still remains some amount of sheets in the printing system 1000, the controller unit 205 may automatically select one paper-feeding unit in which sheets remain so that printing should be continued with the use of the remaining sheets set in the selected paper-feeding unit. With such a modification, it is possible to continue printing until all sheets set in the paper-feeding units have been used.

As explained above, the controller unit 205 can perform the first paper-feeding unit change processing shown in FIG. 10 and the second paper-feeding unit change processing shown in FIG. 11. In addition, a user can switch over between the first paper-feeding unit change processing and the second paper-feeding unit change processing by changing the setting on the screen shown in FIG. 12. By this means, it is possible for the user to select which of these two paper-feeding unit change processing, that is, either the first paper-feeding unit change processing according to which a paper-feeding unit switchover is performed after paper that is set in the paper-feeding unit that is currently being used for print processing has run out, or the second paper-feeding unit change processing according to which a paper-feeding unit switchover is performed before paper that is set in the paper-feeding unit that is currently being used for print processing runs out, is to be performed by the printing apparatus 100.

Figures 13, 13A:
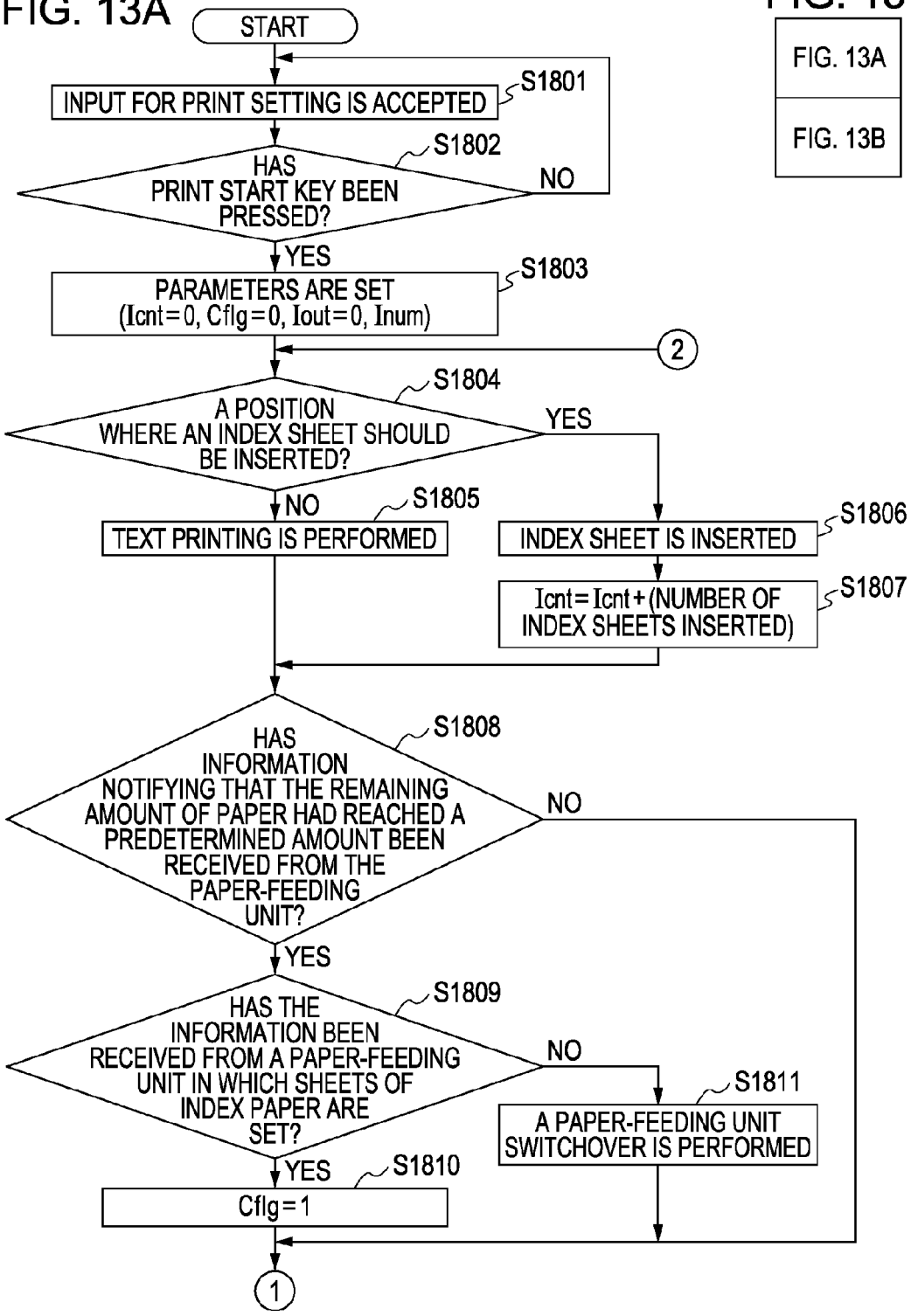
FIG. 13 is a flowchart that schematically illustrates a data processing procedure according to an exemplary embodiment of the invention.
Figure 13B:
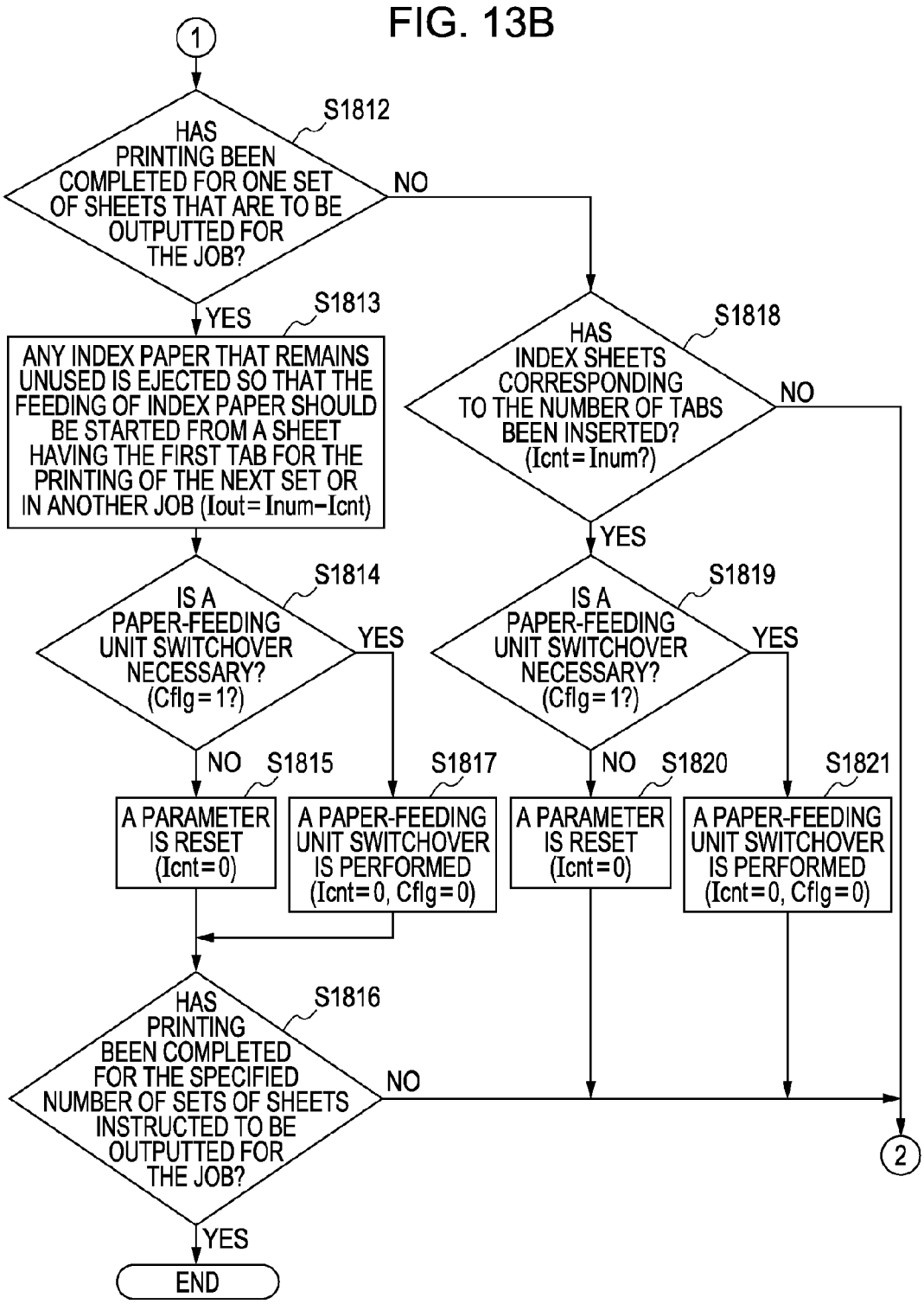

Next, with reference to FIG. 13, an explanation is given of control that is performed by the controller unit 205 when a job instructing the insertion of index sheets is executed. The processing shown in the flowchart of FIG. 13 is performed through the running of a program that is stored in the ROM 207 by the controller unit 205.

Figure 14:
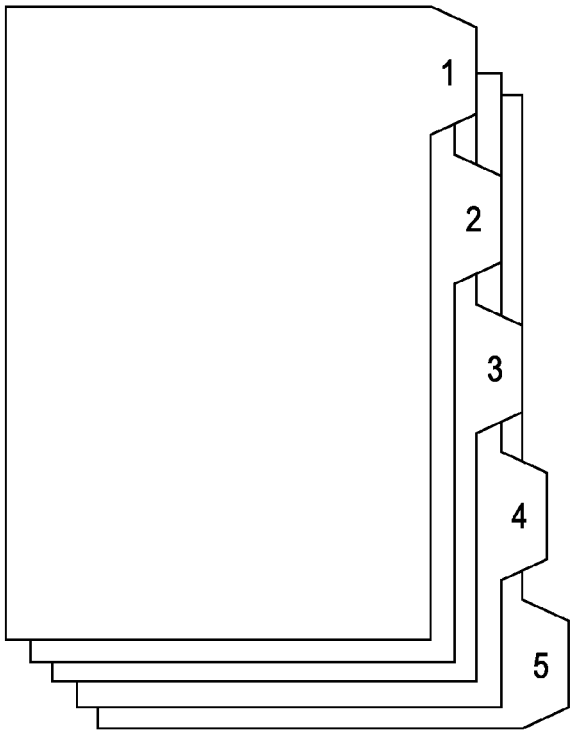
FIG. 14 is a diagram that schematically illustrates one set of index sheets according to an exemplary embodiment of the invention.

In the present embodiment of the invention, it is assumed that the controller unit 205 has received image data that is to be printed out from the PC 103, the PC 104, or the scanner unit 201 and then has stored the received image data in the HDD 209. In addition, it is further assumed herein that a plurality of index sheets each set of which is made up of five sheets as shown in FIG. 14 is set in the paper-feeding cassettes 317 and 318 whereas sheets of plain paper are set in the paper-feeding deck 319 and the manual paper-feeding tray 320. Moreover, it is further assumed herein that values shown in FIG. 9 are set in the paper-feeding unit information table 1301 that is stored in the RAM 208. Furthermore, it is assumed herein that a user has selected the second paper-feeding unit change processing shown in FIG. 11.

Figure 15:
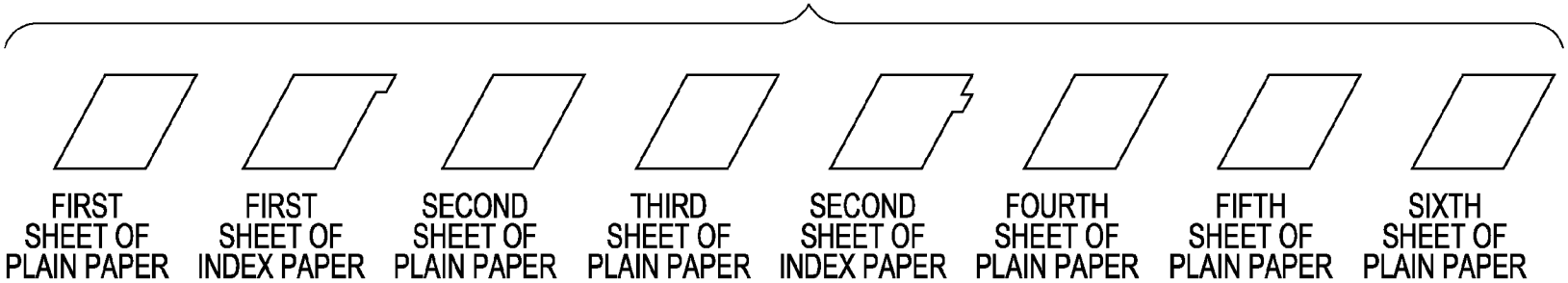
FIG. 15 is a diagram that schematically illustrates a print result according to an exemplary embodiment of the invention.

In the following explanation of an exemplary embodiment of the invention, the controller unit 205 performs printing with the use of index sheets set in the paper-feeding cassettes 317 and 318 and sheets of plain paper set in the paper-feeding deck 319 and the manual paper-feeding tray 320 so as to obtain a print output shown in FIG. 15. FIG. 15 is a conceptual diagram that schematically illustrates an example of a print result of a job that instructs the insertion of two sheets of index paper in six sheets of plain paper in the course of printing. In this example, these two sheets of index paper and six sheets of plain paper make up one print copy, that is, one set of print outputs for the job. Upon the issuance of a printing command by a user under print setting made so as to obtain the print result shown in FIG. 15, the controller unit 205 designates the same single paper-ejecting unit among a plurality of paper-ejecting units of the printing system 1000 as a destination for the ejection of both of plain paper and index paper. Accordingly, as a result of printing, a first sheet of plain paper, a first sheet of index paper, a second sheet of plain paper, a third sheet of plain paper, a second sheet of index paper, a fourth sheet of plain paper, a fifth sheet of plain paper, and a sixth sheet of plain paper are ejected thereto one over another in the order of appearance herein each in a facedown position.

The controller unit 205 uses the following variables that are stored in the RAM 208 when it performs controlling operations shown in the flowchart of FIG. 13.

Inum: This is a variable that stores the number of tabs of index sheets set in paper-feeding units for each index set. In the present embodiment of the invention, it is assumed that a plurality of index sheets each set of which is made up of five sheets as shown in FIG. 14 is set in the paper-feeding cassettes 317 and 318. Therefore, a value "5" has been preset as Inum by the user through the setting made on the screen shown in FIG. 8.

Icnt: This is a variable that stores the number of tabs of index sheets that have been fed from a paper-feeding unit. For example, if the value of Icnt is two, it indicates that the second index sheet that has a tab at the position "2" shown in FIG. 14 has been fed.

Cflg: This is a variable that stores a flag that indicates whether the controller unit 205 has received information that notifies that the remaining amount of sheets set in the paper-feeding unit, that is, the sender of the information, has reached a predetermined amount or not.

Iout: This is a variable that stores the number of index sheets that should be ejected among a plurality of index sheets set in the paper-feeding unit.

In S1801, the controller unit 205 accepts an input for print setting from a user via the operation unit 204 or the user interface of the PC 103 or PC 104. Upon the reception of an input for print setting from the user, the controller unit 205 stores the received print setting into the RAM 208 as printing conditions. The print setting includes, for example, the size of paper that is used for printing, the type thereof, printing color density, printing layout, and the like. When printing is performed with the insertion of index sheets, a user sets the size of index paper as well as page positions where the index sheets should be inserted in text pages.

For example, if a user wants to obtain the printing result shown in FIG. 15, the user makes settings on paper that is used for text printing, that is, text sheets, and further makes settings on paper that is used for index insertion, that is, index sheets. The term "text" means a content portion other than index pages. In this example, the user sets the type of paper that is used for text printing as plain paper and the size thereof as A4. In addition, the user further sets the size of index paper as A4. In addition, the user sets each position in the text pages at which an index sheet should be inserted. In this example, the user specifies that the first sheet of index paper should be inserted between the first sheet of text paper and the second sheet of text paper and further specifies that the second sheet of index paper should be inserted between the third sheet of text paper and the fourth sheet of text paper.

In S1802, the controller unit 205 makes a judgment as to whether the start key 503 has been pressed or not. The processing of S1802 is repeated until the start key 503 is pressed. Then, upon the detection of the pressing of the start key 503, the controller unit 205 judges that it is instructed to start printing operations. Then, the process moves on to S1803. The controller unit 205 performs subsequent print processing in accordance with the printing conditions stored in the RAM 208.

In S1803, the controller unit 205 sets zero for each of Icnt, Cflg, and Iout as an initial value. The controller unit 205 looks up the paper-feeding unit information table 1301 that is stored in the ROM 208 so as to select paper-feeding units that are used for printing. For text printing, as a plain paper-feeding unit, the controller unit 205 selects the paper-feeding deck 319 whose paper size is set as A4 and paper type as plain paper. For index insertion, the controller unit 205 selects the paper-feeding cassette 317 in which sheets of index paper are set as an index paper-feeding unit. Then, the controller unit 205 sets the unit number of tabs of index sheets set in the paper-feeding cassette 317, that is, "5", as the value of Inum. In the foregoing description, it is explained that a user sets the size of index paper so that the controller unit 205 automatically selects a paper-feeding unit in which index sheets each of which has the same size as the user-set size are set. However, the selection of a paper-feeding unit is not limited to such an exemplary method. A user may directly select a paper-feeding unit among a plurality of paper-feeding units as an index paper-feeding source from which sheets of index paper are supplied.

After the processing of S1803, the controller unit 205 repeats the processing of S1804-S1812 and S1818-S1821 until printing has been completed for one print copy, that is, one set of sheets. For example, if the user wants to obtain the printing result shown in FIG. 15, the processing of S1804-S1812 and S1818-S1821 is repeated until printing has been completed for eight sheets of paper that is made up of six sheets of plain paper and two sheets of index paper. Upon the completion of printing for these eight sheets of paper, the operations proceed from S1812 to S1813.

First, in S1804, the controller unit 205 makes a judgment as to whether the judgment-target page position is a position at which an index sheet should be inserted or not. If it is judged in S1804 that the judgment-target page position is not a position at which an index sheet should be inserted, the process moves on to S1805. At S1805, text printing is performed. For example, when printing is performed so as to obtain the print output shown in FIG. 15, one sheet of plain paper is picked up from the paper-feeding deck 319 for the purpose of performing printing on the first sheet of plain paper. Image data that is stored in the HDD 209 is printed out on the supplied plain paper. The plain paper on which printing has been performed is then ejected to the designated paper ejection destination. In this way, the printing of the first sheet of plain paper is performed.

On the other hand, if it is judged in S1804 that the judgment-target page position is a position at which an index sheet should be inserted, the process moves on to S1806. At S1806, the controller unit 205 causes a sheet of index paper to be fed and then be ejected to the designated paper ejection destination. Then, the operations proceed from S1806 to S1807. If the user set in the previous S1801 that image data should be printed out also on sheets of index paper, the controller unit 205 may instruct the printer unit 203 to perform printing on the fed sheet of index paper. By this means, it is possible to print out image data on a sheet of index paper.

Each time when a sheet of index paper or sheets of index paper is/are fed in S1806, the controller unit 205 counts the fed sheet(s) of index paper by means of a sensor that is not shown in the drawing. Then, in S1807, the controller unit 205 increments the value of Icnt by the number of counted sheet(s) thereof. On the other hand, if no index sheet is ejected, the value of Icnt is not incremented.

In S1808, the controller unit 205 makes a judgment as to whether information that notifies that the amount of paper that remains in the paper-feeding unit had reached a predetermined amount has been received from the paper-feeding unit in the course of processing described above. If it is judged in S1808 that such information has been received from the paper-feeding unit, the process moves on to S1809. If it is judged in S1808 that such information has not been received from the paper-feeding unit, the process jumps to S1812.

In S1809, the controller unit 205 identifies the type of a print target medium that is set in the paper-feeding unit that is the sender of the information received in the preceding S1808. If it is judged in S1809 that the sender of the information is a paper-feeding unit in which sheets of plain paper are set, the controller unit 205 performs control so as to carry out a paper-feeding unit switchover at S1811. Specifically, in such a case, the controller unit 205 performs the operations S1503-S1511 of the second paper-feeding unit change processing shown in FIG. 11 at S1811. That is, the controller unit 205 selects a substitute paper-feeding unit in which sheets having the same size and type as those of the sender paper-feeding unit are set as the after-the-change paper-feeding unit so as to continue printing without any pause. For example, it is assumed that the first sheet of plain paper shown in FIG. 15 was fed from the paper-feeding deck 319. Then, information notifying that the amount of paper that remains in the paper-feeding deck 319 has reached a predetermined amount has been received from the paper-feeding deck 319 after the feeding of the first sheet of plain paper. The controller unit 205 performs control so that printing should be continued while using the sheets of paper that remain in the paper-feeding deck 319 until a substitute paper-feeding unit that can take over the paper-feeding operation is found. After such a substitute paper-feeding unit has been found, the controller unit 205 performs control so that the next sheet is fed from the found substitute paper-feeding unit, which takes over the paper-feeding operation from the paper-feeding deck 319. As explained above, in the second paper-feeding unit change processing, when the amount of sheets remaining in a paper-feeding unit that is currently being used for print processing has reached a predetermined amount, the controller unit 205 performs control so that a substitute paper-feeding unit should be searched for while continuing the print processing with the use of sheets of paper remaining therein. It should be particularly noted that, in the second paper-feeding unit change processing, the search for such a substitute paper-feeding unit is started before the sheets of paper that are set in the paper-feeding unit that is currently being used for print processing run out. By this means, it is possible to prevent the occurrence of downtime due to a paper-feeding failure.

If it is judged in S1809 that the sender of the information notifying that the amount of paper that remains therein has reached the predetermined amount is a paper-feeding unit in which sheets of index paper are set, the controller unit 205 stores "1" in Cflg in S1810. For example, it is assumed that the first sheet of index paper shown in FIG. 15 was fed from the paper-feeding cassette 317. Then, information notifying that the amount of paper that remains in the paper-feeding cassette 317 has reached a predetermined amount has been received from the paper-feeding cassette 317 after the feeding of the first sheet of index paper. In such a case, the controller unit 205 sets the value of Cflg into "1" in 51810 without immediately performing the operations S1503-S1511 of the second paper-feeding unit change processing at this operation stage (S1810). On the basis of the Cflg value of 1, the second paper-feeding unit change processing will be performed later in S1817 or S1821. The second paper-feeding unit change processing performed in S1817 or S1821 is explained later. The reason why the controller unit 205 performs control as described above so that a paper-feeding unit switchover should not be immediately performed at this moment but be performed later is to prevent the sequential positions of tabs of index sheets included in a print output from becoming disordered. For example, it is assumed that the first sheet of index paper, which has a tab at the position "1" shown in FIG. 14 has been fed from the paper-feeding cassette 317. After the feeding of the first sheet of index paper from the paper-feeding cassette 317, a paper-feeding unit switchover is carried out. Then, the second sheet of index paper is fed from the paper-feeding cassette 318. In order to ensure correct sequence of tabs of index sheets, it is necessary for a sheet of index paper that has a tab at the position "2" shown in FIG. 14 to be set in the paper-feeding cassette 318 as the next feeding-target paper, which is waiting to be fed first. If a sheet of index paper that has a tab at the position "1" shown in FIG. 14 is set in the paper-feeding cassette 318 as the next feeding-target paper, which is waiting to be fed first, the above-mentioned sheet of index paper having the first tab is inserted at a position where a sheet of index paper having the second tab is supposed to be inserted, which must be avoided. In most cases, a sheet of index paper that has a tab at the tab position "1" is set at the uppermost sheet position in a paper-feeding unit. A sheet set at the uppermost sheet position is the next feeding-target paper, which is waiting to be fed first. For this reason, incorrect sequence of tabs of index sheets explained above is likely to occur. In order to avoid such an index tab sequence error, upon the reception of information that notifies that the amount of paper that remains in the paper-feeding unit that is currently being used for printing has reached the predetermined amount, the controller unit 205 identifies the type of paper set in the paper-feeding unit that is the sender of the information; then, if it is judged that the sender of the information is a paper-feeding unit in which sheets of index paper are set, the controller unit 205 performs a paper-feeding unit switchover not immediately but only after the ejection of one set of index sheets.

In S1812, the controller unit 205 makes a judgment as to whether printing has been completed for one print copy, that is, one set of sheets that are to be outputted for the job for which the user issued a request for job execution. In the example shown in FIG. 15, the controller unit 205 judges whether printing on the sixth sheet of plain paper has been completed or not.

If it is judged in S1812 that printing has not been completed yet for a set of sheets that are to be outputted for the job, the process moves on to S1818. At S1818, the controller unit 205 compares the value of Icnt with the value of Inum. If these two values disagree, the controller unit 205 returns the operations to S1804 so as to continue printing for one print copy. If these values agree with each other, the process moves on to S1819.

In S1819, the controller unit 205 makes a judgment as to whether the value of Cflg is set as 1, which indicates that the remaining amount of index sheets has reached the predetermined amount, or not. If the controller unit 205 judges that Cflg is not 1, the process moves on to S1820. At S1820, the value of Icnt is reset into 0. Then, the controller unit 205 returns the operations to S1804 so as to continue printing for one print copy without performing a paper-feeding unit switchover. As an example of cases where the operations proceed to S1820, it may be instructed that twelve index sheets whose one set of tabs is made up of five tabs should be inserted for each print copy, that is, each set of print outputs for a job. In such an exemplary case, after the insertion of the fifth sheet of index paper, the value of Icnt is reset into 0 in 51820. After the resetting of Icnt, a sheet of index paper that has a tab at the position 1 shown in FIG. 14 is inserted as the sixth sheet of index paper.

On the other hand, if it is judged in 51819 that Cflg is set as 1, the controller unit 205 recognizes that it is necessary to switch from the paper-feeding unit that is currently being used for the feeding of index paper to a substitute paper-feeding unit. Then, the process moves on to S1821. In S1821, the controller unit 205 performs an index paper-feeding unit switchover. Specifically, the controller unit 205 sets a substitute index paper-feeding unit in which index sheets having the same size and type as those of the index paper-feeding unit that is currently being used for the feeding of index paper as a new paper-feeding source from which index sheets will be supplied after the switchover. At the operation timing of S1821, index sheets whose number corresponds to one set of tabs have now been fed from the before-the-change paper-feeding unit defined earlier. If a paper-feeding unit switchover is carried out at such a point in time, the sequential positions of tabs of index sheets included in a print output will not be disordered, thereby making it possible to ensure correct tab sequence in the printing result.

For example, print processing is performed with the use of a plurality of index sheets each set of which is made up of five sheets as shown in FIG. 14. The plurality of index sheets is supplied from the paper-feeding cassette 317. After the controller unit 205 has judged in S1818 that the five sheets of index paper have now been inserted, the processing of S1821 is performed. By this means, when a paper-feeding unit change is performed so as to switch from the paper-feeding cassette 317 to the paper-feeding cassette 318, which a plurality of index sheets each set of which is made up of five sheets as shown in FIG. 14 is set in, the continued insertion of index paper is started from an index sheet that has a tab at the position "1". Thus, it is possible to ensure the correct tab sequence in the printing result.

In addition, if a paper-feeding unit switchover is performed at the timing of S1821, the tab position of the next feeding-target index paper that will be fed first among a plurality of index sheets set in the paper-feeding cassette 317 before the change is "1". Therefore, when the paper-feeding cassette 317 is used in another job, the feeding of index sheets starts from an index sheet that has a tab at the position "1". Thus, it is also possible to ensure correct tab sequence in the printing result in the above-mentioned another job.

Note that a search for a substitute index paper-feeding unit that can take over the index paper-feeding operation may have been, preferably, performed in the processing of S1810 instead of starting such a search at the timing of S1821 so that a switchover to the substitute index paper-feeding unit that has been found in advance can be performed in S1821 immediately. With such a modified operation, it is possible to reduce extra waiting time taken for finding a substitute index paper-feeding unit that can take over the index paper-feeding operation in S1821.

A series of operations described above is repeated until it is judged in S1812 that printing has been completed for a set of sheets that are to be outputted for the job (i.e., one print copy). When the controller unit 205 judges in S1812 that printing has been completed for a set of sheets that are to be outputted for the job, the operations proceed from S1812 to S1813.

Figure 16:
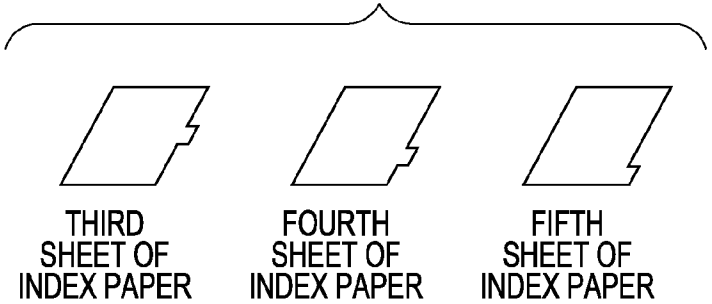
FIG. 16 is a diagram that schematically illustrates unused index sheets according to an exemplary embodiment of the invention.

In S1813, the controller unit 205 ejects any index paper that remains unused for the printing of the above-mentioned one print copy in the paper-feeding unit that is the index paper-feeding source from which sheets of index paper are supplied. For example, when a set of sheets shown in FIG. 15 is ejected as a result of printing performed with the use of a paper-feeding unit in which index sheets shown in FIG. 14 are set, two index sheets are included in the print output whereas three index sheets shown in FIG. 16 remain unused in the paper-feeding unit. In the example shown in FIG. 15, two index sheets that have tabs at the positions "1" and "2" are included in the print output whereas three index sheets that have tabs at the positions "3", "4", and "5" remain unused in the paper-feeding unit. Therefore, in S1813, the controller unit 205 ejects these three index sheets that have tabs at the positions "3", "4", and "5". Through the execution of an operation shown in S1813, it is possible to start the feeding of index paper from a sheet that has a tab at the position "1" when the paper-feeding unit is used for the printing of the next set of sheets, that is, the next print copy, or for printing in another job.

In S1813, the remaining index sheets are ejected to a paper ejection port that is not the same as a paper ejection port to which the set of print outputs for the job is ejected. By this means, it is possible to prevent the ejected index sheets from being mixed up with the set of print outputs for the job. Therefore, it is not necessary for a user to sort the set of print outputs from the ejected index sheets that were not used, which is burdensome to the user. Or, the user may have predetermined a paper ejection port to which unused index sheets should be ejected.

In S1814, the controller unit 205 makes a judgment as to whether the value of Cflg is set as 1, which indicates that the remaining amount of index sheets has reached the predetermined amount, or not. If the controller unit 205 judges that Cflg is not 1 in S1814, the process moves on to S1815. At S1815, the controller unit 205 resets the value of Icnt into 0. Then, the process moves on to S1816 without the execution of an index paper-feeding unit switchover.

If the controller unit 205 judges that Cflg is 1 in S1814, which indicates that the remaining amount of index sheets has reached the predetermined amount, the controller unit 205 performs processing for an index paper-feeding unit switchover. When the controller unit 205 performs processing for an index paper-feeding unit switchover, the controller unit 205 sets the values of Icnt and Cflg into 0. Then, the process moves on to S1816. Note that a search for a substitute index paper-feeding unit that can take over the index paper-feeding operation may have been, preferably, performed in the processing of 51810 instead of starting such a search at the timing of S1817 so that a switchover to the substitute index paper-feeding unit that has been found in advance can be performed in S1817 immediately. With such a modified operation, it is possible to reduce extra waiting time taken for finding a substitute index paper-feeding unit that can take over the index paper-feeding operation in S1817.

In S1816, the controller unit 205 judges whether printing has been completed for the specified number of sets of sheets instructed to be outputted for the job under execution or not. That is, the controller unit 205 judges whether printing has been completed for the specified number of copies instructed to be outputted for the job under execution or not. If it is judged that printing has not been completed yet for the specified number of sets of sheets that should be outputted for the job under execution, the controller unit 205 returns the operations to S1804 so as to start printing for the next set (i.e., next copy). If it is judged that printing has been completed for the specified number of sets of sheets that should be outputted for the job under execution, the controller unit 205 ends processing shown in FIG. 13.

As explained above, when the amount of paper that remains in the paper-feeding unit that is currently being used for printing has reached the predetermined amount, it is possible to perform a paper-feeding unit switchover at appropriate timing depending on the type of paper that is set in the paper-feeding unit. For example, when it is detected that the amount of paper that remains in the paper-feeding unit has become small, a paper-feeding unit switchover is performed immediately if the type of paper that is set in the paper-feeding unit is plain paper. On the other hand, if the type of paper that is set in the paper-feeding unit for which it is detected that the amount of paper that remains therein has become small is certain paper whose one set is made up of a plurality of sheets, an example of which is index paper, the paper-feeding source is switched from the above-mentioned paper-feeding unit to a substitute paper-feeding unit at a point in time after the ejection of one set of the paper.

With such a control, it is possible to output a correct printing result while avoiding printing operations from being paused due to a failure in the feeding of paper that occurs as a result of the running-out of sheets set in the paper-feeding unit that is currently being used.

In the foregoing description of an exemplary embodiment of the invention, it is explained that, in S1809, the controller unit 205 identifies the type of a print target medium (e.g., paper) set in the paper-feeding unit that is the sender of the information that notifies that the amount of paper remaining in the paper-feeding unit has reached the predetermined amount. Then, if the type of paper that is set in the paper-feeding unit for which it is detected that the amount of paper that remains therein has reached the predetermined amount is certain paper whose one set is made up of a plurality of sheets, an example of which is index paper, the paper-feeding source is switched from the above-mentioned paper-feeding unit to a substitute paper-feeding unit at a point in time after the ejection of one set of the paper. However, a method for making a judgment in S1809 is not limited to the identification of the type of a print target medium that is set in the paper-feeding unit. For example, the method for making a judgment in S1809 explained above may be modified as follows. At least, the number of sheets that make up one set is stored in the paper-feeding unit. On the basis of the stored information on the number of sheets that are included in one set, the controller unit 205 makes a judgment as to whether sheets each set of which is made up of more than one sheet are set in the paper-feeding unit or not. When the amount of sheets that remain in the paper-feeding unit has reached the predetermined amount, the controller unit 205 performs control so that the feeding of paper should be continued until the number of sheets that have been fed from the paper-feeding unit reaches a number that is a multiple of the number of sheets that make up one set, which is denoted as "n" (n: natural number). When the number of sheets that have been fed from the paper-feeding unit reaches such a multiple, the controller unit 205 performs control so as to carry out a paper-feeding unit switchover. With such modified control, it is not always necessary for a user to preset the type of paper for the paper-feeding unit. That is, it suffices if, at least, a user presets that sheets each set of which is made up of more than one sheet are set therein.

In the following description, an example of the configuration of a data processing program that can be read by an image processing apparatus according to an exemplary embodiment of the invention is explained while referring to a memory map shown in FIG. 17.

FIG. 17 is a diagram that schematically illustrates an example of a memory map of a storage medium in which various kinds of data processing programs that can be read by an image processing apparatus according to an exemplary embodiment of the invention are stored. A print control program, a program for executing the operations shown in the flowchart of FIG. 10, a program for executing the operations shown in the flowchart of FIG. 11, and a program for executing the operations shown in the flowchart of FIG. 13 are stored in the storage medium.

Though not specifically illustrated therein, information for managing a group of programs that are stored in the storage medium may also be stored therein. Examples of such information are version information, creators, and the like. In addition to such managing information, information that depends on an operating system (OS) employed at the program reader side, an example of which is an icon for identifying a program, may also be stored therein.

Moreover, data that belongs to various programs are also managed. Furthermore, a program for installing various programs on a computer, a program for decompressing programs that is used when the programs have been compressed, and the like may also be stored.

Functions according to the present embodiment of the invention may be implemented by a host computer through a program installed from outside. The present invention is applicable to a case where a group of information including programs is supplied to an output apparatus through a storage medium such as a CD-ROM, a flash memory, an FD, and the like or from an external storage medium via a network.

As explained above, a storage medium that stores a program code of software that implements the functions according to the present embodiment of the invention to a system or an apparatus. Then, a computer (or a CPU or an MPU) of the system or that of the apparatus reads out the program code that is stored in the storage medium and then executes the read-out program. Even when such a configuration is adopted, needless to say, the object of the present invention can be achieved.

In such a configuration, a program code itself that is read out of the storage medium implements a novel function of the present invention. The storage medium in which the program code is stored constitutes at least a part of an exemplary embodiment of the present invention.

Therefore, the mode of a program is not specifically limited herein as long as it has a program function; for example, it may be an object code, a program that is run by an interpreter, script data that is supplied to the OS, or the like.

As a storage medium that is used for supplying a program, for example, a flexible disk, a hard disk, an optical disk, a magneto-optical (MO) disk, a CD-ROM, a CD-R, a CD-RW, a magnetic tape, a nonvolatile memory card, a ROM, a DVD, and the like can be used.

In such a configuration, a program code itself that is read out of the storage medium implements a novel function of the foregoing exemplary embodiment of the present invention. The storage medium in which the program code is stored constitutes at least a part of an exemplary embodiment of the present invention.

There are the following methods for supplying a program. For example, a user accesses to a Web page over the Internet with the use of a PC browser and then downloads a computer program according to an exemplary embodiment of the present invention from the Web page into a storage medium such as a hard disk or the like. In this way, the program can be supplied. Or, a user may download a compressed file that has an automatic installation function into a storage medium such as a hard disk or the like so that the program should be supplied. Or, a program code that constitutes an example of a program according to an exemplary embodiment of the present invention may be divided in a plurality of files. A user may download these files from Web pages different from one another. The supplying of a program can be performed even with such a configuration. That is, a WWW server or an FTP server that allows a plurality of users to download program files that are used for causing a computer to perform functional processing of an exemplary embodiment of the invention are also encompassed within the scope of claims of the present invention.

A program according to an exemplary embodiment of the present invention may be encrypted and stored in a storage medium such as a CD-ROM or the like so that the stored program can be distributed to users. Some users that satisfy a predetermined condition or a predetermined set of conditions only are allowed to download, from a Web page, key information that can be used for the decryption thereof. The allowed user uses the downloaded key information so as to run the decrypted program for the installing thereof on a computer. In this way, the supplying of a program can be performed.

Note that the scope of the present invention is not limited to such a case where the functions of exemplary embodiments of the invention described above are implemented through the execution of program codes read out by a computer. For example, an operating system (OS) working on a computer or the like may perform a part of, or a whole of, actual processing in accordance with the instructions of the program codes so that the aforementioned functions according to exemplary embodiments of the present invention should be implemented through the processing performed thereby.

Furthermore, it is possible to perform control in accordance with the instructions of program codes read out of a storage medium after the writing of the program codes into a function expansion board that is inserted in a computer or into a memory of a function expansion unit that is connected to the computer. For example, a CPU of the function expansion board or a CPU of the function expansion unit may perform a part of, or a whole of, actual processing so that the aforementioned functions according to exemplary embodiments of the present invention should be implemented through the processing performed thereby.

While the present invention has been described with reference to exemplary embodiments, it is to be understood that the invention is not limited to the disclosed exemplary embodiments. The scope of the following claims is to be accorded the broadest interpretation so as to encompass all equivalent structures and functions.

What is claimed is:

1. A printing apparatus for executing a job with sheets stored in at least one of a first sheet-feeding unit and a second sheet-feeding unit, each of the first sheet-feeding unit and the second sheet-feeding unit being able to store a plurality of sets of sheets, comprising:

a holding unit configured to hold number information indicating the number of sheets included in one set of sheets;

a determining unit configured to determine whether the amount of sheets that remain in the first sheet-feeding unit in which the plurality of sets of sheets have been stored and which is used for the execution of a job has reached a predetermined amount which is not zero; and a control unit configured to change, after it is determined by the determining unit that the amount of sheets that remain in the first sheet-feeding unit has reached the predetermined amount, the sheet-feeding unit that is used for the execution of the job from the first sheet-feeding unit to the second sheet-feeding unit in a state that at least one sheet remains in the first sheet feeding unit, wherein the control unit controls, after it is determined by the determining unit that the amount of sheets that remain in the first sheet-feeding unit has reached the predetermined amount, to feed the last sheet which is determined by the number indicated by the number information held by the holding unit from the first sheet-feeding unit.

2. The printing apparatus according to claim 1, wherein the control unit discriminates a type of the sheet that has been stored in the first sheet-feeding unit, and wherein, the control unit changes the sheet-feeding unit that is used for the execution of the job from the first sheet-feeding unit to the second sheet-feeding unit after it is determined by the determining unit that the amount of sheets that remain in the first sheet-feeding unit has reached the predetermined amount, in a case where it is discriminated that the type of the sheet that has been stored in the first sheet-feeding unit is not a certain sheet each set of which is made up of a plurality of sheets.

3. The printing apparatus according to claim 1, further comprising a receiving unit configured to receive the number information indicating the number of sheets included in the one set of sheets from a user, wherein the holding unit holds the number information indicating the number of sheets received by the receiving unit.

4. The printing apparatus according to claim 1, wherein the determining unit determines whether the amount of sheets that remain in the first sheet-feeding unit in which the plurality of sets of sheets have been stored and that is used for the execution of the job has reached the predetermined amount during the execution of the job.

5. The printing apparatus according to claim 1, wherein the control unit makes a judgment as to whether printing for one copy has been completed or not, wherein, in a case where it is detected that printing for the job has been completed, the control unit controls to eject remaining sheets that remain unused for the printing of the one copy among the one set of sheets to an ejection destination.

6. The printing apparatus according to claim 5, wherein the control unit selects an ejection destination to which the sheets should be ejected.

7. A control method for controlling a printing apparatus that executes a job with sheets stored in at least one of a first sheet-feeding unit and a second sheet-feeding unit, each of the first sheet-feeding unit and the second sheet-feeding unit being able to store a plurality of sets of sheets, the control method comprising:

holding, in a holding unit, number information indicating the number of sheets included in one set of sheets;

determining whether the amount of sheets that remain in the first sheet-feeding unit in which the plurality of sets of sheets have been stored and which is used for the execution of the job has reached a predetermined amount which is not zero;

changing, after it is determined that the amount that remain in the first sheet-feeding unit has reached the predetermined amount, a sheet-feeding unit that is used for the execution of the job from the first sheet-feeding unit to the second sheet-feeding unit in a state that at least one sheet remains in the first sheet feeding unit; and controlling, after it is determined that the amount of sheets that remain in the first sheet-feeding unit has reached the predetermined amount, to feed the last sheet which is determined by the number indicated by the number information held in the holding unit from the first sheet-feeding unit.

8. The control method according to claim 7, further comprising discriminating a type of the sheets that has been stored in the first sheet-feeding unit for identification, wherein the sheet-feeding unit that is used for the execution of the job is changed from the first sheet-feeding unit to the second sheet-feeding unit after it is determined that the amount of sheets that remain in the first sheet-feeding unit has reached the predetermined amount, in a case where it is discriminated that the type of the sheet that has been stored in the first sheet-feeding unit is not a certain sheet each set of which is made up of a plurality of sheets.

9. The control method according to claim 7, further comprising receiving the number information indicating the number of sheets included in the one set from the user, wherein the received number information indicating number of sheets is held in the holding unit.

10. The control method according to claim 7, wherein the determination as to whether the amount of sheets that remain in the first sheet-feeding unit in which the plurality of sets of sheets have been stored and which is used for the execution of the job has reached the predetermined amount is performed during the execution of the job.

11. The control method according to claim 7, further comprising detecting whether printing for the one copy has been completed or not, wherein, in a case where it is detected in the above-mentioned detection that printing for the one copy has been completed, sheets that remain unused for the printing of the one copy among the one set of sheets are ejected to an ejection destination.

12. The control method according to claim 11, further comprising selecting an ejection destination to which the sheets should be ejected.

13. A non-transitory computer-readable recording medium storing a computer-executable process, the computer-executable process causing a printing apparatus that executes a job with sheets stored in at least one of a first sheet-feeding unit and a second sheet-feeding unit, each of the first sheet-feeding unit and the second sheet-feeding unit being able to store a plurality of sets of sheets, to execute a method comprising:

holding, in a holding unit, number information indicating the number of sheets included in one set of sheets;

determining whether the amount of sheets that remain in the first sheet-feeding unit in which the plurality of sets of sheet has been stored and which is used for the execution of the job has reached a predetermined amount which is not zero; and changing, after it is determined that the amount of sheets that remain in the first sheet-feeding unit has reached the predetermined amount, the sheet-feeding unit that is used for the execution of the job from the first sheet-feeding unit to the second sheet-feeding unit in a state that at least one sheet remains in the first sheet feeding unit, controlling, after it is determined that the amount of sheets that remain in the first sheet-feeding unit has reached the predetermined amount, to feed the last sheet which is determined by the number indicated by the number information held in the holding unit from the first sheet-feeding unit.

14. A printing apparatus for executing a job for outputting sheets stored in at least one of a first sheet-feeding unit and a second sheet-feeding unit, each of the first sheet-feeding unit and the second sheet-feeding unit being able to store a plurality of sets of sheets having an order, comprising:

a holding unit configured to hold number information indicating the number of sheets included in one set of sheets;

a determining unit configured to determine whether the amount of sheets that remain in the first sheet-feeding unit in which the plurality of sets of sheets have been stored and which is used for the execution of a job has reached a predetermined amount which is not zero; and a control unit configured to change, after it is determined by the determining unit that the amount of sheets that remain in the first sheet-feeding unit has reached the predetermined amount, the sheet-feeding unit that is used for the execution of the job from the first sheet-feeding unit to the second sheet-feeding unit so that an order of output sheets is correct in a state that at least one sheet remains in the first sheet feeding unit.

* * * * *